US008225623B2

(12) United States Patent
Ikeda et al.

(10) Patent No.: US 8,225,623 B2
(45) Date of Patent: Jul. 24, 2012

(54) CENTRIFUGAL FAN, AIR CONDITIONER

(75) Inventors: Takashi Ikeda, Chiyoda-ku (JP); Naho Takehara, Chiyoda-ku (JP); Hiroshi Tsutsumi, Chiyoda-ku (JP); Takahiro Yamatani, Chiyoda-ku (JP); Kazunobu Nishimiya, Chiyoda-ku (JP); Masaaki Iseki, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 529 days.

(21) Appl. No.: 12/529,262

(22) PCT Filed: Feb. 19, 2008

(86) PCT No.: PCT/JP2008/052690

§ 371 (c)(1),
(2), (4) Date: Aug. 31, 2009

(87) PCT Pub. No.: WO2008/111368

PCT Pub. Date: Sep. 18, 2008

(65) Prior Publication Data

US 2010/0115983 A1 May 13, 2010

(30) Foreign Application Priority Data

Mar. 14, 2007 (JP) ..... 2007-065050

(51) Int. Cl.
*F25D 17/06* (2006.01)

(52) U.S. Cl. ..... 62/419; 62/426

(58) Field of Classification Search ..... 62/426, 62/419, 314, 414, 404, 412; 415/204, 211.1, 415/228

See application file for complete search history.

(56) References Cited

U.S. PATENT DOCUMENTS 4,647,271 A * 3/1987 Nagai et al. ..... 416/186 R (Continued)

FOREIGN PATENT DOCUMENTS

EP 0 942 175 A1 9/1999

(Continued)

OTHER PUBLICATIONS

Office Action from Chinese Patent Office issued in corresponding Chinese Patent Application No. 200880007841.8 dated Oct. 29, 2010.

(Continued)

*Primary Examiner* — Mohammad Ali

(74) *Attorney, Agent, or Firm* — Buchanan Ingersoll & Rooney PC

(57) ABSTRACT

To obtain an air conditioner having a lower-noise centrifugal fan capable of improving product reliability during transportation and execution properties of installation, with reduced packaging materials in favor of environment. The shape of a blade is formed so that when a blade edge positioned on the downstream side of the blowing direction is designated as a blade rear-edge, the centrifugal fan has a relationship of the outer diameter of the side plate>the outer diameter of the blade rear-edge on the side of a side plate>the outer diameter of the blade rear-edge on the side of a main plate≧the outer diameter of the main plate, and the blade rear-edge is located inside of a straight line connecting a connection point between the blade rear-edge and the main plate to a connection point between the blade rear-edge and the side plate relative to the rotation axis of the fan, and the distance between the blade rear edge and the rotation axis increases toward the side plate from the main plate.

14 Claims, 24 Drawing Sheets

U.S. PATENT DOCUMENTS

| | | | | |
|---|---|---|---|---|
| 4,946,348 | A * | 8/1990 | Yapp | 415/211.2 |
| 5,281,083 | A * | 1/1994 | Ito et al. | 415/55.1 |
| 6,663,342 | B2 * | 12/2003 | Huang et al. | 415/121.2 |
| 6,769,876 | B2 * | 8/2004 | Sakai et al. | 416/187 |
| 6,848,887 | B2 * | 2/2005 | Kim | 416/186 R |
| 6,851,928 | B2 * | 2/2005 | Tam et al. | 415/211.2 |
| 7,066,712 | B2 * | 6/2006 | Kim et al. | 415/58.4 |
| 7,108,482 | B2 * | 9/2006 | Chapman | 416/185 |
| 7,191,613 | B2 * | 3/2007 | Lee | 62/262 |
| 7,241,110 | B2 * | 7/2007 | Chang et al. | 415/184 |
| RE39,774 | E * | 8/2007 | Chang | 415/208.2 |
| 7,331,758 | B2 * | 2/2008 | Arinaga et al. | 415/221 |

FOREIGN PATENT DOCUMENTS

| | | | |
|---|---|---|---|
| JP | 4-263710 | A | 9/1992 |
| JP | 4-263715 | A | 9/1992 |
| JP | 5-039930 | A | 2/1993 |
| JP | 7-004389 | A | 1/1995 |
| JP | 11-101198 | A | 4/1999 |
| JP | 2007-170331 | A | 7/2007 |

OTHER PUBLICATIONS

Office Action from UK Intellectual Property Office issued in corresponding British Patent Application No. GB0913682.1 dated Apr. 19, 2011.

Form PCT/ISA/210 of Application No. PCT/JP2008/052690 dated May 20, 2008.

Non-English version of Form PCT/ISA/237 of Application No. PCT/JP2008/052690 dated May 20, 2008.

* cited by examiner (b) — (b)

Q 3

(a) FORMING MOLD MOVEMENT STEP (b) RESIN INFUSION STEP (c) RESIN COOLING STEP (d) MOLD RELEASING STEP (e) MOLDED BODY PICKING OUT STEP k 1 − k 2 − k 3 − k 4

CENTRIFUGAL FAN, AIR CONDITIONER

TECHNICAL FIELD

The present invention relates to a centrifugal fan for use in an air conditioner for air-freshening and air cooling/heating, and also relates to an air conditioner incorporating the centrifugal fan.

BACKGROUND ART

For example, in Patent Document 1, a twisted vane centrifugal fan is described in that on each blade front-edge, the position of a side plate connection position is off-set relative to that of a main plate connection portion by a predetermined value in a rotational direction of an impeller.

Also, in Patent Document 2, a turbo fan and an apparatus having the turbo fan mounted thereon are described in that a blade of an impeller has a horizontal sectional curved shape, in which from the blade front-edge to the position where radius is R about a center axis, the more the blade proceeds toward the outer circumference of the impeller, the more the blade becomes positioned rearward in the rotating direction of the impeller, and from the position where radius is R to a blade rear-edge, the blade shape approaches a parallel line with an extended line connecting the center axis to the position where radius is R, so that the blade on the outer circumferential side from the position where radius is R is curved in the rotating direction to the blade on the inner circumferential side.

Furthermore, in Patent Document 3, a flush-mounting ceiling-type air conditioner having a conventional centrifugal fan mounted thereon is described in that at a position located apart from a ceiling air conditioner body, a ceiling plane suction port is provided while a side wall of the body is provided with a body suction port having a filter. A heat exchanger is provided on the back of the body suction port to oppose it. Within a space surrounded by an air guide plate and a ceiling panel, a blower is arranged. The ceiling panel mounted on the bottom of the body is provided with only a ceiling panel blow out port.

[Patent Document 1] Japanese Unexamined Patent Application Publication No. H05-39930

[Patent Document 2] Japanese Unexamined Patent Application Publication No. H07-4389

[Patent Document 3] Japanese Unexamined Patent Application Publication No. H04-263710

DISCLOSURE OF INVENTION

Problems to be Solved by the Invention

A conventional centrifugal fan and air conditioner are configured as described above; however, they have problems as follows.

In a centrifugal fan mounted on the air conditioner described in Patent Document 1, a blade forms a three-dimensional profile, and when its blade rear-edge part is curved to be convex in the rotational direction of the impeller, the blade is formed on the fan inner circumferential side of a straight line connecting between points at which the blade rear-edge part is connected to the main plate and the side plate, so that to manufacture it, an expensive slide mold with a complicated structure is required.

In the turbofan described in Patent Document 2, the blade shape formed with a plane parallel with the rotation axis can be integrally molded; however, when the shape of the blade rear-edge part has unevenness in relation to a straight line connecting between the points at which the blade rear-edge part is connected to the main plate and the side plate, the blade is difficult to be integrally molded. Also, when the blade shape has a projection located outside the impeller from a straight line connecting between the connection points to the main plate and the side plate and in the vicinity of the intermediate portion in the height direction, so that the blade is difficult to be integrally molded, the airflow blowing out of a fan internal flow path surrounded by the main plate and the side plate is disturbed due to the existence of the blade. Therefore, there is a fear that the noise level is increased when the fan is mounted on an air conditioner having a heat exchanger and a blow-out port provided on the downstream side.

Furthermore, in the flush-mounted ceiling-type air conditioner described in Patent Document 3, when a centrifugal fan is used as a blower, the fan is arranged to protrude downward from an air conditioner body and is covered with a ceiling panel. However, before installation, the body is separated from the ceiling panel, so that the centrifugal fan is arranged in a protruded state from the body, thereby damaging the fan during transportation. Also, for preventing the fan from being damaged, a lot of packaging materials are required for surrounding the fan protruded from the body, deteriorating environment. Furthermore, the centrifugal fan has problems that parts count is increased due to a guide vane required on the blowing-out side of the fan, and the airflow may be instabilized against an external turbulence due to small increase of the total pressure.

In order to solve the problems described above, the present invention has been made, so that it is an object of the present invention to obtain a lower-noise air conditioner with improved product reliability during transportation, improved installation properties, and less use of packaging materials in favor of environment.

Means for Solving the Problems

A centrifugal fan according to a first present invention includes a main plate having a flat portion formed on the outer circumferential side and a convex boss formed at the center for serving as a fixing part to a rotation shaft of a motor; a side plate having an air guide wall provided to surround around the boss with a predetermined space therebetween; and a plurality of blades provided between the main plate and the side plate substantially perpendicularly to a plane orthogonal to the rotation axis of the fan, in which due to rotation of the plurality of blades, air is sent from a suction port formed between the wall of the main plate on the side of the boss and an end portion of the side plate opposing the wall on the side of the boss, toward a blow-out port formed between an external circumferential side flat portion of the main plate and an end portion of the side plate opposing the external circumferential side flat portion. Furthermore, when a blade edge positioned on the downstream side of the blowing direction is designated as a blade rear-edge, the centrifugal fan has a relationship of the outer diameter of the side plate>the outer diameter of the blade rear-edge on the side of the side plate>the outer diameter of the blade rear-edge on the side of the main plate≧the outer diameter of the main plate, and the blade rear-edge is located inside of a straight line connecting a connection point between the blade rear-edge and the main plate to a connection point between the blade rear-edge and the side plate relative to the rotation axis, and the distance between the blade rear edge and the rotation axis increases toward the side plate from the main plate.

Advantages

According to the present invention, a centrifugal fan includes a main plate having a flat portion formed on the outer circumferential side and a convex boss formed at the center for serving as a fixing part of a rotation shaft of a motor; a side plate having an air guide wall provided to surround the boss with a predetermined space therebetween; and a plurality of blades provided between the main plate and the side plate substantially perpendicularly to a plane orthogonal to the rotation axis of the fan, in which due to rotation of the plurality of blades, air is sent from a suction port formed between the wall of the main plate on the side of the boss and an end portion of the side plate opposing the wall on the side of the boss, toward a blow-out port formed between the external circumferential flat portion of the main plate and an end portion of the side plate opposing the external circumferential flat portion. Further, when a blade edge positioned on the downstream side of the blowing direction is designated as a blade rear-edge, the centrifugal fan has a relationship of the outer diameter of the side plate>the outer diameter of the blade rear-edge on the side of the side plate>the outer diameter of the blade rear-edge on the side of the main plate≧the outer diameter of the main plate, and the blade rear-edge is located inside of a straight line connecting a connection point between the blade rear-edge and the main plate to a connection point between the blade rear-edge and the side plate relative to the rotation axis, and the distance between the blade rear edge and the rotation axis increases toward the side plate from the main plate. Thereby, the pressure changes along the wall of the side plate or the main plate are suppressed by avoiding the airflow concentration onto the main plate side or onto the side plate side so as to obtain a low-noise air conditioner with improved the product reliability during transportation, improved installation properties, and less use of packaging materials in favor of environment.

REFERENCE NUMERALS

1: centrifugal fan, 1*a*: fan suction port, 1*b*: fan blow-out port, 1*bd*: blade-outlet maximal curved point that is intersection point of the blade-outlet representative line A and its perpendicular passing through maximal curved part 4*bd*, 2: main plate, 2*a*: boss, 3: side plate, 3*a*: straight tubular side-plate suction part constituting fan suction port 1*a*, 3*b*: air guide wall of side plate constituting air guide part inside fan, 3*c*: side plate concave part, 3*c*1: plane of side plate concave part substantially perpendicular to rotation axis 3*d*: side-plate suction inner circumferential end, 4: blade, 4*a*: blade front-edge, 4*as*: connection point between blade front-edge 4*a* and side plate 3 (blade front-edge side-plate side connection part), 4*b*: blade rear-edge, 4*bd*: maximal curved part of blade rear-edge, 4*bm*: connection point between blade rear-edge 4*b* and main plate 2 (blade rear-edge main plate side connection part), 4*bs*: connection point between blade rear-edge 4*b* and side plate 3, 4*c*: step formed by thickness difference between the inner blade part 4*e* and the outer blade part 4*d* on the blade parting line B therebetween, 4*d*: outer blade part on outer circumferential side of blade parting line B, 4*e*: inner blade part on inner circumferential side of blade parting line B, 4*s*: warped line, 5*a*: forming mold on main plate side, 5*a*1: part corresponding to side plate concave part 3*c* of forming mold on main plate side, 5*b*: forming mold on side plate side, 5*b*1: part corresponding to side plate concave part 3*c* of forming mold on side plate side, 6: airflow guide plate, 6*a*: bell-mouth, 6*b*: air guide blow-out port, 6*c*: air guide wall guiding blow-out airflow of centrifugal fan, 7: fan motor, 20: air conditioner body, 20*a*: body suction port, 20*b*: body side wall, 20*c*: body top board, 21: dust filter, 22: heat exchanger, 23: ceiling panel, 23*a*: ceiling panel blow-out port, 23*b*: wind-direction vane, 24: drain pan, 30: room, 30*a*: ceiling, 30*b*: loft, 31: ceiling suction port

BEST MODES FOR CARRYING OUT THE INVENTION

First Embodiment

Figure 1:
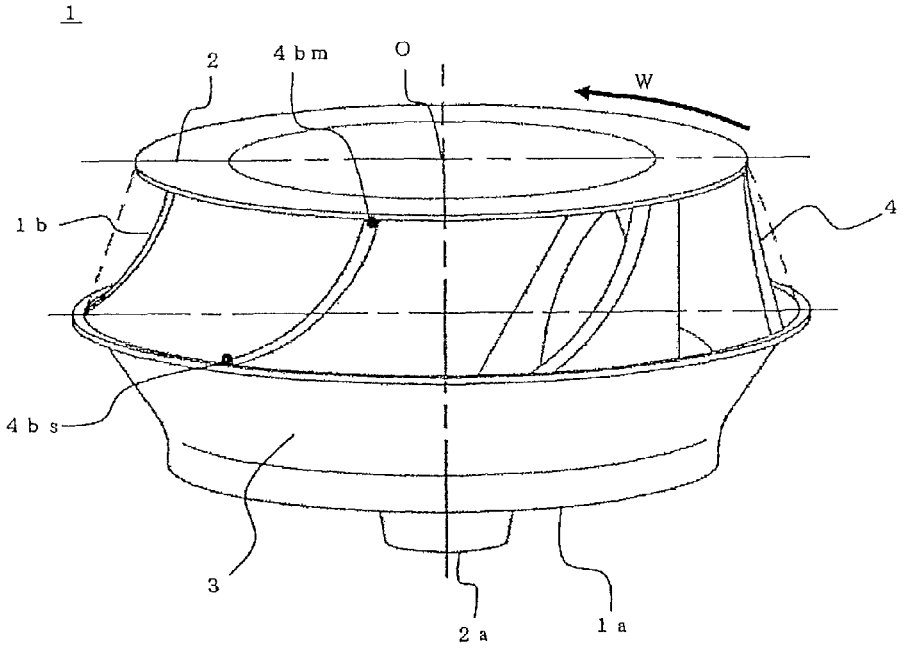
FIG. 1 is a perspective view of a centrifugal fan according to a first embodiment of the present invention.
Figure 2:
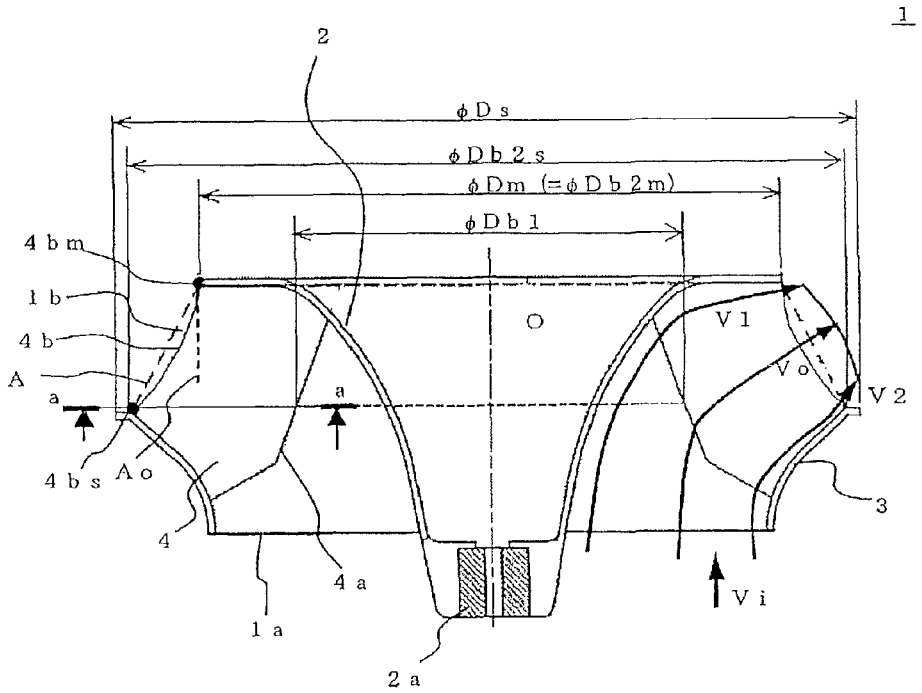
FIG. 2 is a longitudinal sectional view of the centrifugal fan of FIG. 1 in which blades are projected on a common section together with a rotation axis.
Figure 3:
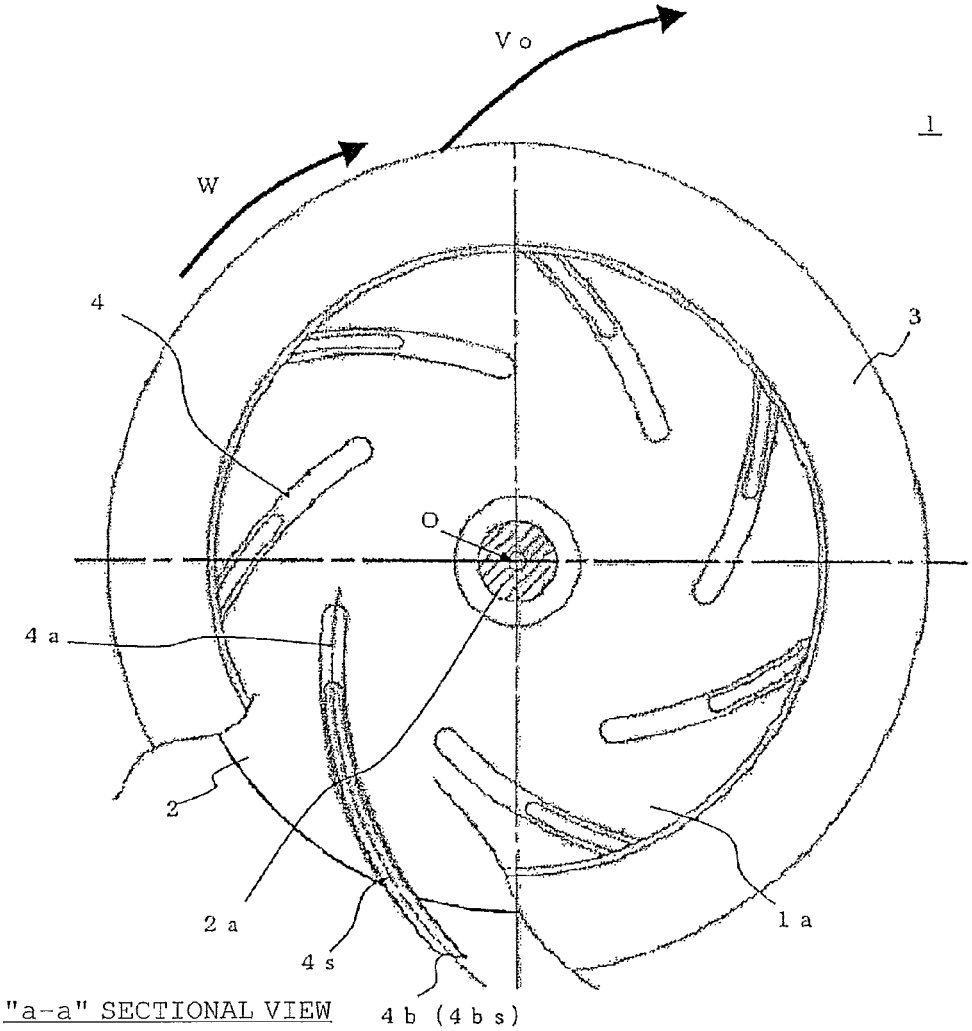
FIG. 3 is a plan view of the centrifugal fan including a sectional view along the line "a-a" of FIG. 2 viewed from the fan suction side.

A centrifugal fan according to a first embodiment of the present invention will be described below with reference to FIGS. 1 to 4. FIG. 1 is a perspective view of the centrifugal fan of the first embodiment of the present invention; FIG. 2 is a longitudinal sectional view in which a blade is projected on a common section with a rotation axis in FIG. 1; and FIG. 3 is a plan view including a sectional view along the line a-a in FIG. 2 viewed from the fan suction side.

In FIG. 1, a main plate 2 has a convex shape extending toward the fan suction center with an external circumferential flat portion. At the apex of the convex shape, a boss 2*a* is integrally formed for serving as a fixing part of a rotation shaft of a motor. A blade 4 forms a two-dimensional profile, and a plurality of the blades 4 are raised from the main plate 2 orthogonally to a plane perpendicular to the rotation axis 0. Also, as shown in FIG. 3, the blade 4 has a profile in that the warped center line 4*s* indicating a center line of the blade thickness in the direction of the rotation axis has the same blade sectional shape, which extends rearward to the reverse rotation direction.

A fan suction port 1*a* of a centrifugal fan 1 is formed of the wall of the main plate 2 on the side of a boss and the end portion on the suction side of a side plate 3 opposing the wall on the side of the boss. The side plate 3 also forms a suction guide wall. The centrifugal fan 1 is made of a thermoplastic resin such as ABS, AS, PP, and PS.

As shown in FIG. 2, in the centrifugal fan 1, the following relation holds: a side plate outer diameter Ds>a blade rear edge on the side of the side plate outer diameter Db2*s*>a blade rear edge on the side of the main plate outer diameter Db2*m*≧an outer diameter Dm. A blade outer diameter Db2 and a blade inner diameter Db1 of circles about the rotation axis 0, which are tangential to a blade rear edge 4*b* and a blade front edge 4*a* at an optional height of the fan, respectively, gradually increase toward the side plate 3 from the main plate 2 in the direction of the rotation axis. The blade rear edge 4*b* is located inside the fan from a blade-outlet representative line A, which is a straight line (broken line in the drawing) connecting between a blade rear-edge main plate side connection part 4*bm* and a blade rear-edge side plate side connection part 4*bs*, which are connection points between the blade 4 and the main plate 2 and that between the blade 4 and the side plate 3, respectively, and the distance between the blade rear edge 4*b* and the rotation axis 0 increases toward the side plate from the main plate.

In FIG. 2, the blade rear edge 4*b* has a concave shape that increasingly inclines at least toward the outside the blade relative to a blade-outlet inclination reference line AO which passes the blade rear-edge main plate side connection part 4*bm* in parallel with the rotation axis 0.

As shown in FIG. 3, the thickness of the blade 4 gradually decreases from the main plate 2 (rear of the plane of the figure) toward the side plate 3 (front of the plane of the figure), and blade top end parts of a fan part which is integrally formed of a plurality of the blades 4 and the main plate 2 are fixed to the side plate 3, so as to be integrally formed.

When the centrifugal fan 1 configured in such a manner is rotated in a rotational direction W by a fan motor (not shown), air is sucked from the fan suction port 1*a* (arrow Vi), and is ejected from the blade rear edge 4*b* and a fan blow-out port 1*b* (arrow Vo) after passing through the fan inside surrounded by the side plate 3, the main plate 2, and the blades 4.

In a conventional centrifugal fan in that a main plate outer diameter<a side plate outer diameter is satisfied, and the blade rear edge 4*b* is formed in a straight line, when air blows out in a direction substantially perpendicular to the blade rear edge 4*b*, the air speed along the blade on the side-plate side is higher than that on the main plate side where a chord length L of the blade on the side-plate side is longer than that on the main plate side; whereas in the centrifugal fan 1 according to the embodiment of the present invention, by forming the blade rear edge 4*b* in a concave shape, the flow on the main plate side blows out in an oblique direction with a touch of a radial direction (arrow v1) while the flow on the side-plate side blows out in an oblique direction with a touch of an axial direction (arrow v2), so that the airflow is finally concentrated toward the substantial center after blowing out of the fan blow-out port 1*b*. In the conventional centrifugal fan, the blade rear edge 4*b* is formed in a straight line, whereas, according to the embodiment, the airflow concentration to the main plate side or to the side plate side is consequently avoided, so that pressure changes are suppressed on the wall of the side plate or the main plate on the opposite side, reducing noise. Also, since the blades 4 do not protrude outside from the main plate 2 and the side plate 3, damage due to dropping during transportation is extremely reduced, improving reliability.

As a result, a centrifugal fan with low noise and high reliability in transportation can be provided.

Second Embodiment

A centrifugal fan according to a second embodiment of the present invention will be described below with reference to FIGS. 4 to 7. Main constitution and corresponding characters of the centrifugal fan are shown in common with the first embodiment.

Figure 4:
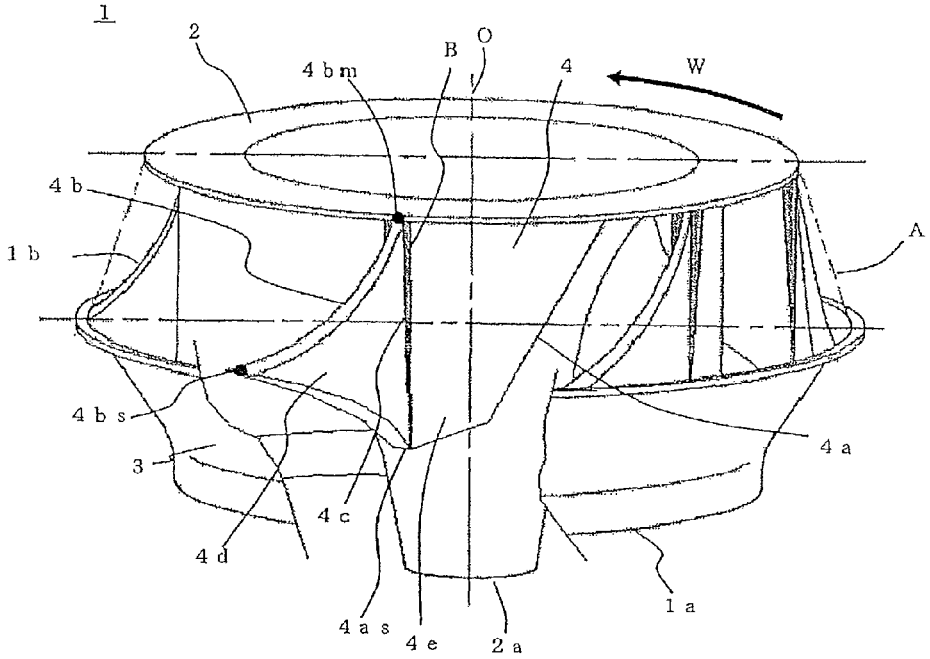
FIG. 4 is a perspective view of a centrifugal fan according to a second embodiment of the present invention, with a side plate is partly removed.
Figure 5:
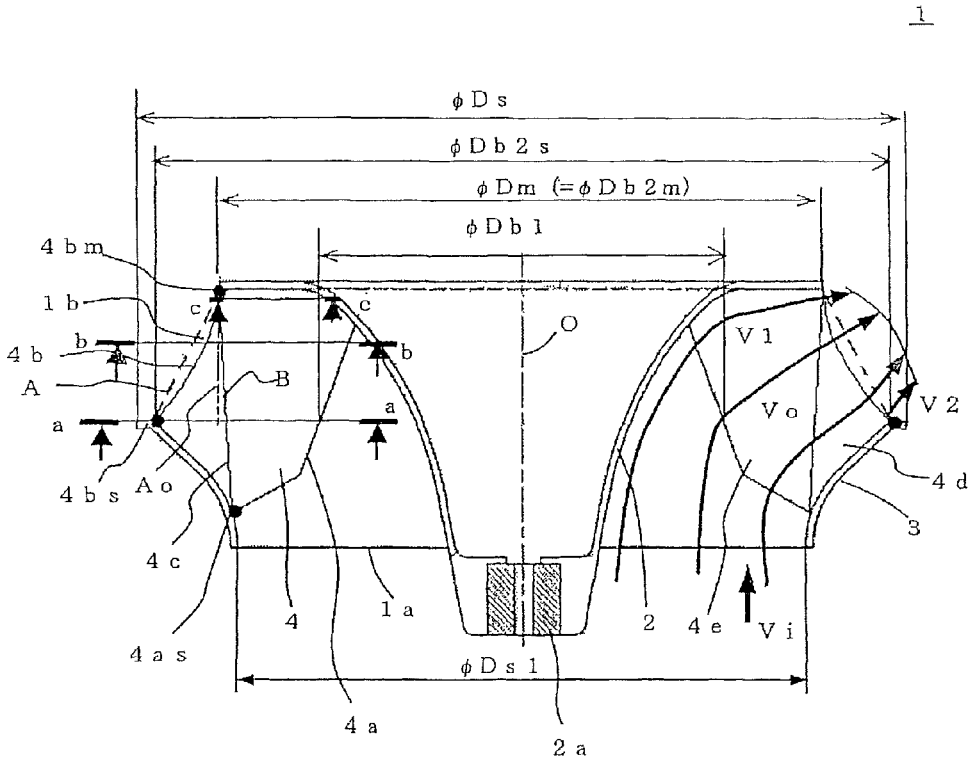
FIG. 5 is a longitudinal sectional view of the centrifugal fan of FIG. 4 in which blades are projected on a common section together with a rotation axis.
Figure 6:
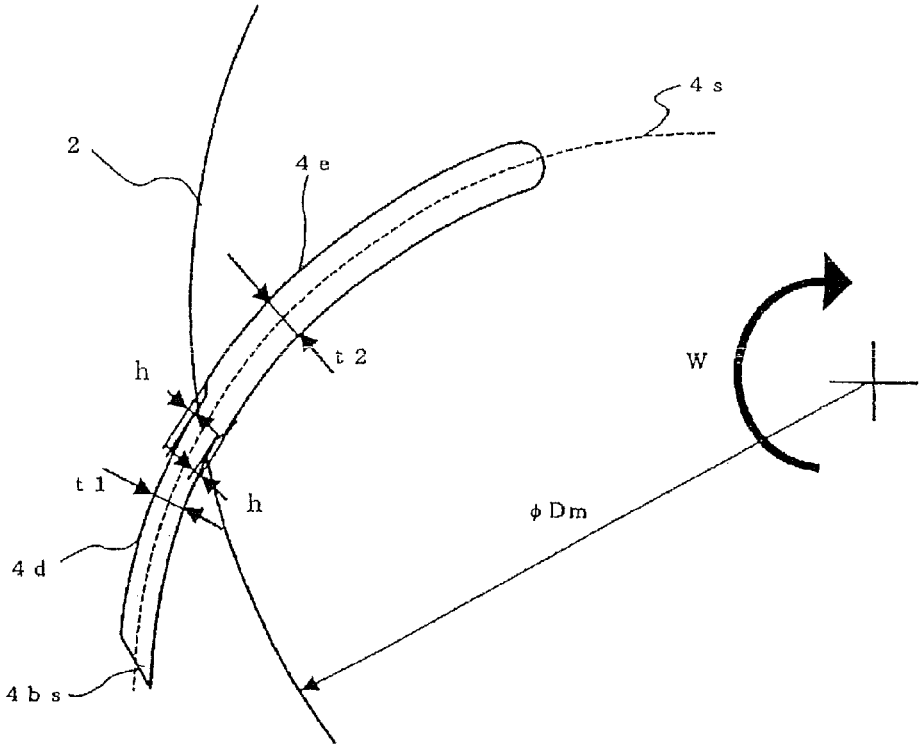
FIG. 6 is a horizontal sectional view of the blade along the line "a-a" of FIG. 4.
Figure 7:
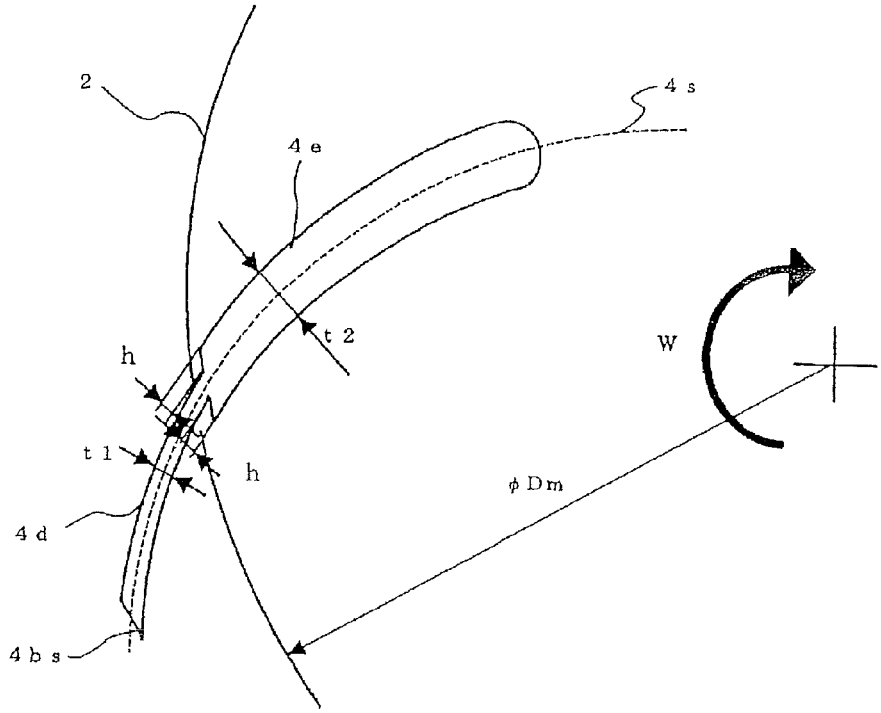
FIG. 7 is a horizontal sectional view of the blade along the line "b-b" of FIG. 4.
Figure 8:
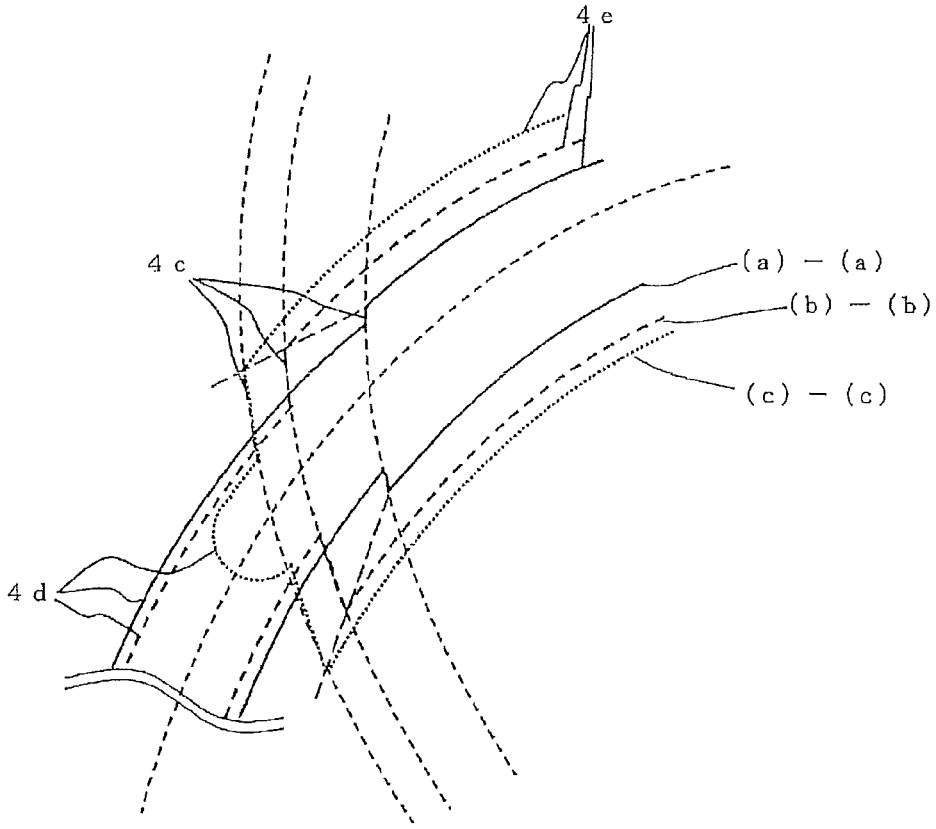
FIG. 8 is a schematic sectional view showing changes in blade thickness along the lines "a-a", "b-b", and "c-c" of the centrifugal fan of the second embodiment.

FIG. 4 is a perspective view of a centrifugal fan according to an embodiment of the present invention, with a side plate partly removed; FIG. 5 is a longitudinal sectional view of the centrifugal fan of FIG. 4 in which blades are projected on a common section together with a rotation axis; FIG. 6 is a horizontal sectional view of the blade along the line "a-a" of FIG. 5; FIG. 7 is a horizontal sectional view of the blade along the line "b-b" of FIG. 5; and FIG. 8 is a schematic view stepwisely showing changes in blade thicknesses t1 and t2 of an outer blade part 4*d* and an inner blade part 4*e* for every the lines "a-a", "b-b", and "c-c" of FIG. 5. Main constitutional and corresponding characters are shown in common with the first embodiment.

As shown in FIGS. 4 and 5, the centrifugal fan has the same configuration as that of the first embodiment in respects that the relation of the side plate outer diameter Ds>the blade rear edge on the side plate side outer diameter Db2*s*>the blade rear edge on the main plate side outer diameter Db2*m*=the outer diameter Dm is satisfied, and the blade rear edge 4*b* has a concave shape that inclines at least toward the outside the fan relative to the blade-outlet inclination reference line AO. According to the second embodiment; each blade 4 of the centrifugal fan 1 includes a step 4*c*.

As shown in FIG. 6, on the line "a-a", the step 4*c* between the outer blade part 4*d* and the inner blade part 4*e* is not so large, while on the line "b-b" shown in FIG. 7, the step 4*c* between them is larger than that of FIG. 6.

As shown in FIG. 8, the thickness t1 of the outer blade part 4*d* on the outer circumferential side of a blade parting line B (FIG. 5), which is a straight line connecting between the blade rear-edge main plate side connection part 4*bm* and the blade rear-edge the side plate side connection part 4*bs*, gradually increases from the main plate 2 toward the side plate 3 (i.e., from the line "c-c" toward the line "a-a"). In contrast, the thickness t2 of the inner blade part 4*e* on the inner circumferential side of the main plate 2 decreases gradually. Furthermore, in the direction of the rotation axis, at least, the thickness t1 of the outer blade part 4*d*<the thickness t2 of the inner blade part 4*e* holds. The blade thickness difference between the inner blade part 4*e* and the outer blade part 4*d* on the blade parting line B forms the step 4*c*, and its height h is formed to gradually increase toward the main plate 2 from the side plate 3. According to the second embodiment, the blade rear-edge main plate side connection part 4*bm* is formed outside a blade front-edge side plate side connection part 4*as* relative to the rotation axis 0.

By forming the centrifugal fan 1 in such a manner, when air blows out substantially perpendicular to the blade rear edge 4*b* as shown in FIG. 5, the airflow concentration to the main plate side or to the side plate side is avoided, differently from the case of a conventional centrifugal fan with the straight blade rear edge 4*b*, so that pressure changes are suppressed on the wall on the side of the side plate or the main plate, reducing noise, in the same way as in the first embodiment.

Figure 9:
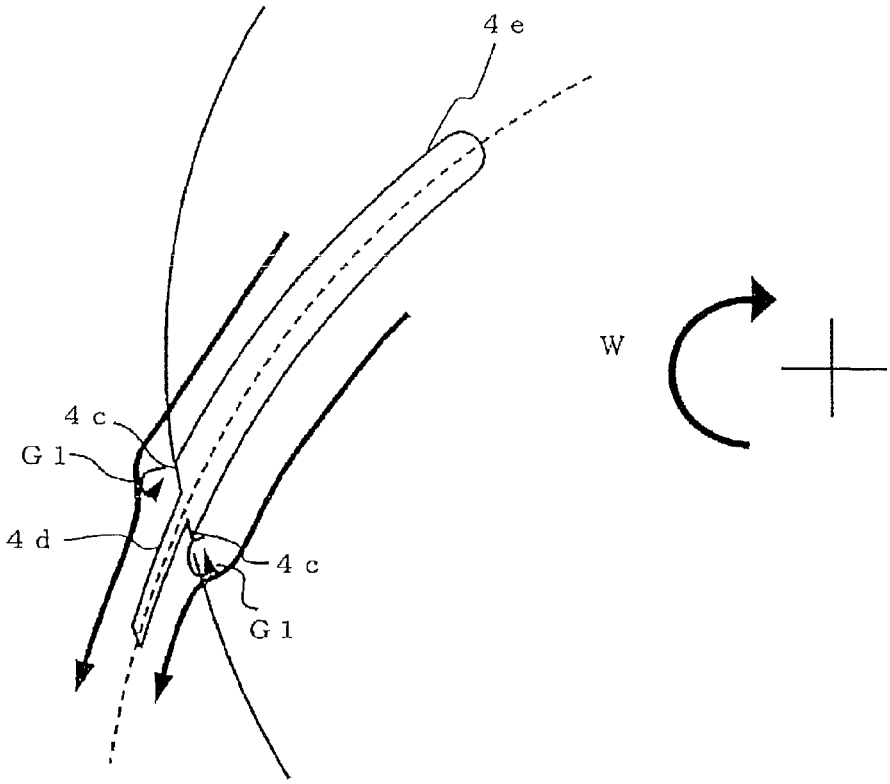
FIG. 9 is a horizontal sectional view along the line "b-b".

Furthermore, as shown in FIG. 9 that is the sectional view of the blade 4 along the line (b)-(b) of FIG. 7, by providing the step 4*c*, an eddy G1 is generated to have a negative pressure at the step 4*c* during air-flowing from the inner blade part 4*e* toward the outer blade part 4*d*, so that air comes to flow along the surface of the outer blade part 4*d*, reducing the air-flow separation at the outer blade part 4*d*, which is produced without the step 4*c* to suppress air-flow turbulence, and the noise can be further reduced.

As described above in FIGS. 6 and 7, the blade is shaped so that the height h of the step 4*c* formed due to the thickness difference between the inner blade part 4*e* and the outer blade part 4*d* along the blade parting line B therebetween, gradually increases toward the main plate 2 from the side plate 3. Thereby, the eddy G1 generated at the step 4*c* on the side of the main plate 2 has a larger negative pressure than that on the side of the side plate 3, so that the airflow tending to blow out radially due to a centrifugal force of the fan is guided toward the rotation axis direction, and when the airflow in the vicinity of the main plate 2 blows out, the airflow can be directed in an oblique direction without interference with the main plate 2, suppressing turbulence and noise. As a result, a centrifugal fan with lower noise can be provided.

Third Embodiment

A centrifugal fan according to a third embodiment of the present invention will be described below with reference to FIGS. 10 to 15. Main constitution and corresponding characters of the centrifugal fan are shown in common with the first and second embodiments.

Figure 10:
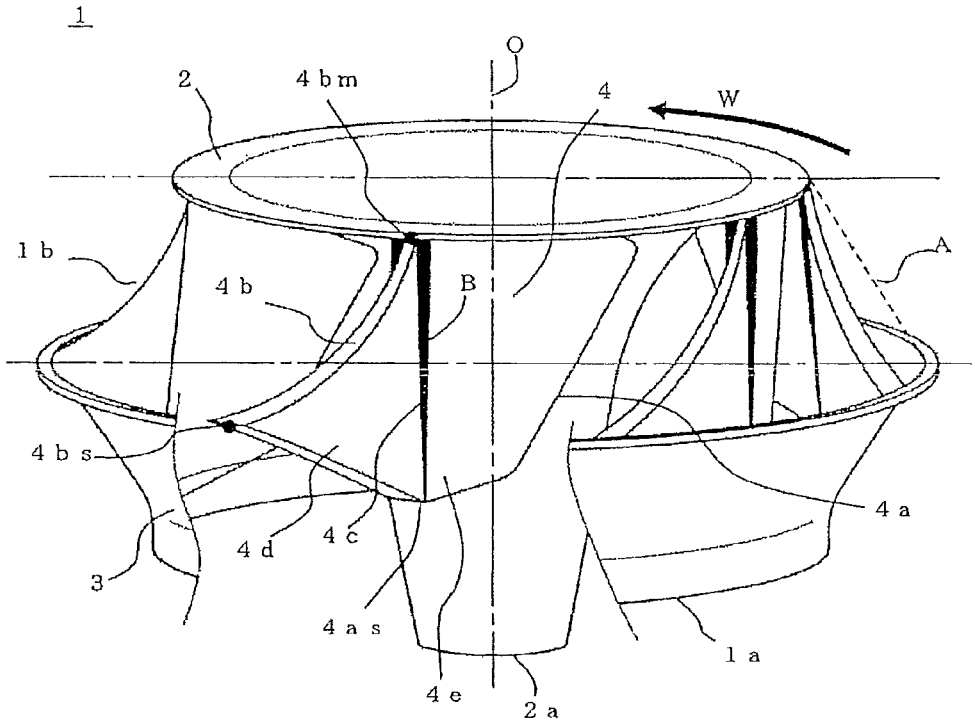
FIG. 10 is a perspective view of a centrifugal fan according to a third embodiment of the present invention, with a side plate partly removed.
Figure 11:
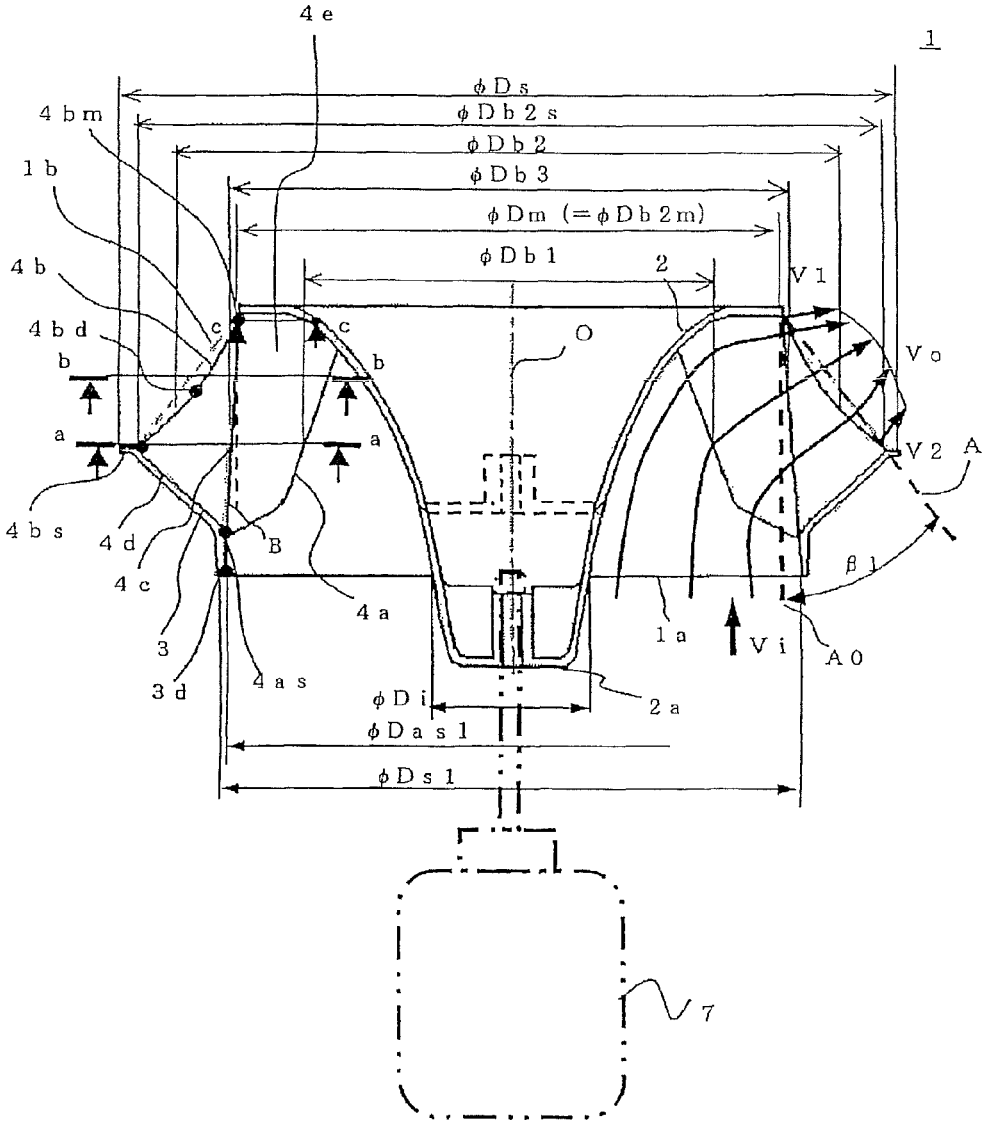
FIG. 11 is a longitudinal sectional view of the centrifugal fan of FIG. 10 in which blades are projected on a common section together with a rotation shaft.
Figure 12:
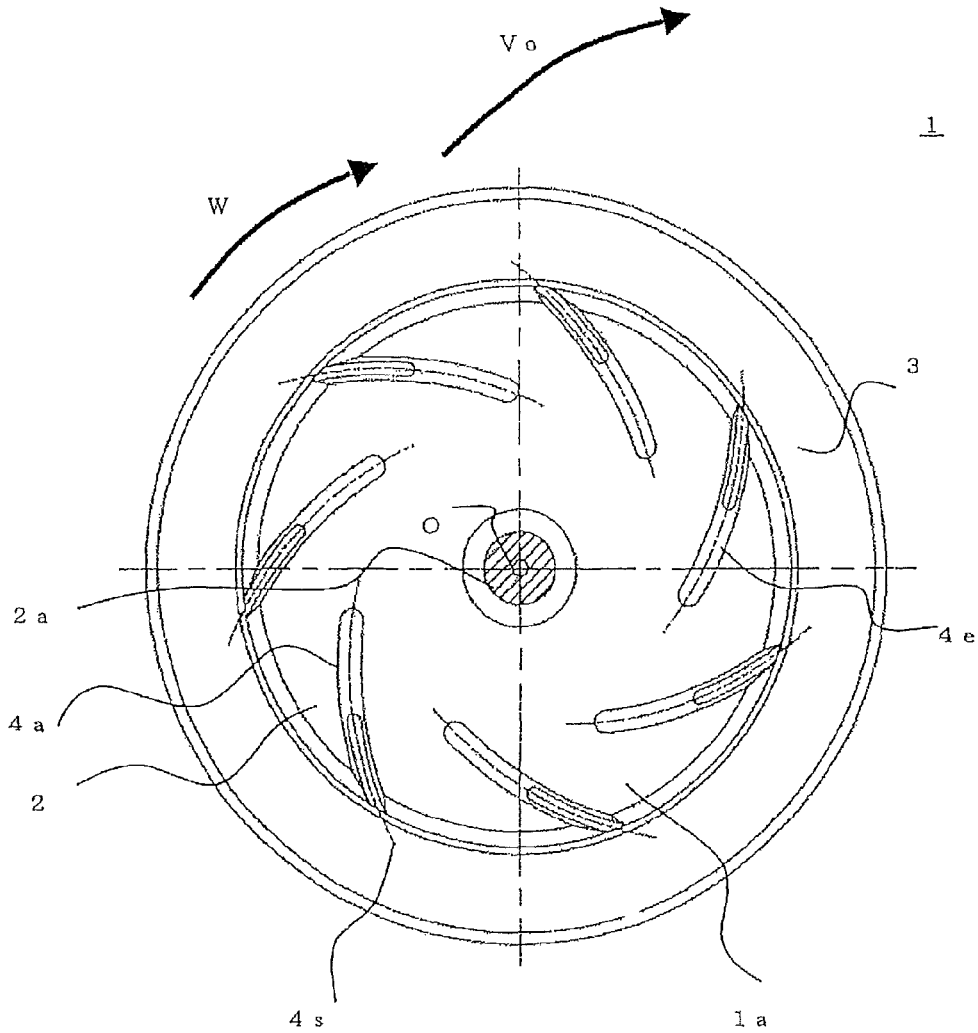
FIG. 12 is a plan view of the centrifugal fan of FIG. 10 viewed from the fan suction side.
Figure 13:
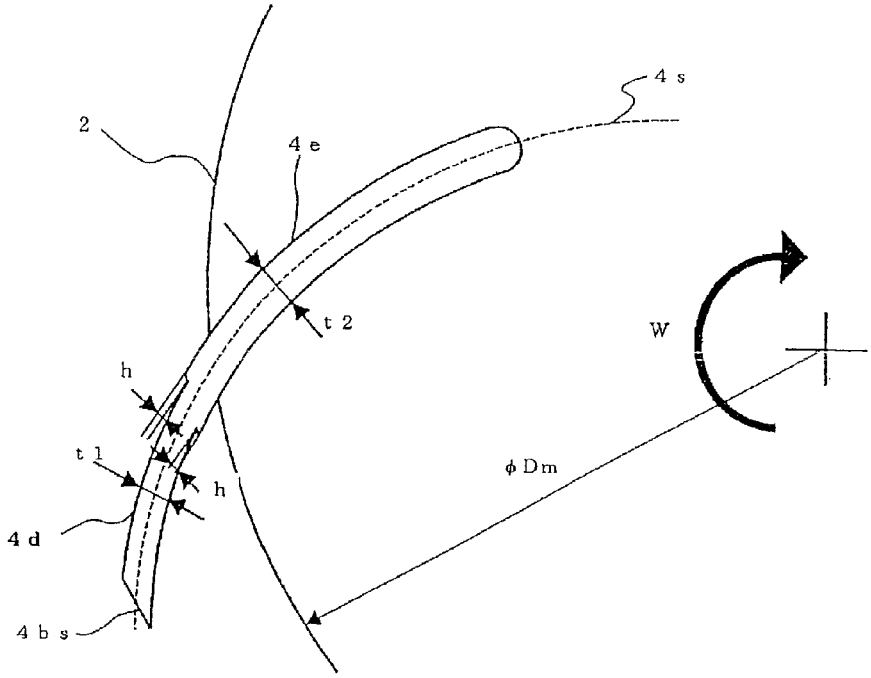
FIG. 13 is a horizontal sectional view of the blade along the line "a-a" of FIG. 11.
Figure 14:
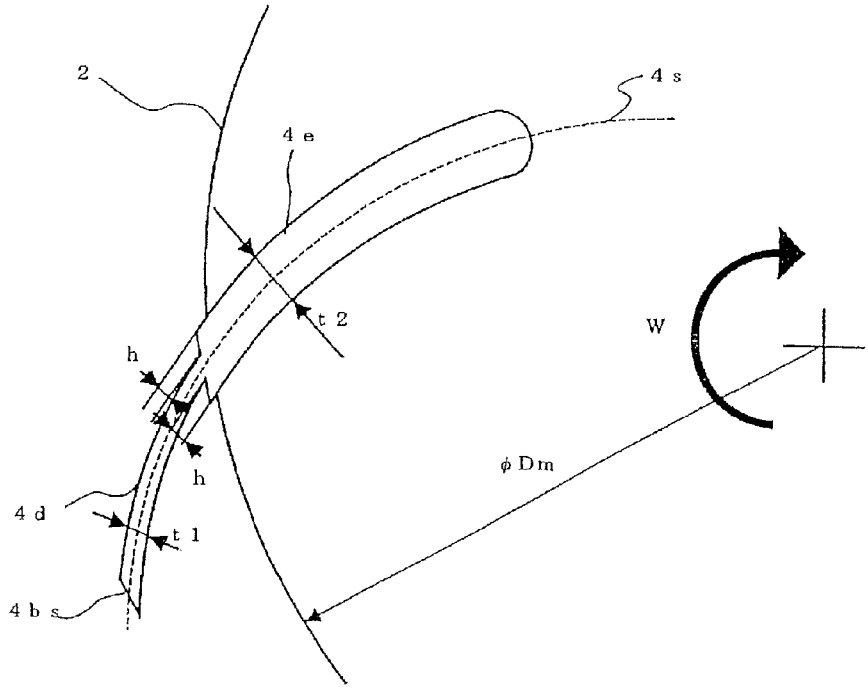
FIG. 14 is a horizontal sectional view of the blade along the line "b-b" of FIG. 11.
Figure 15:
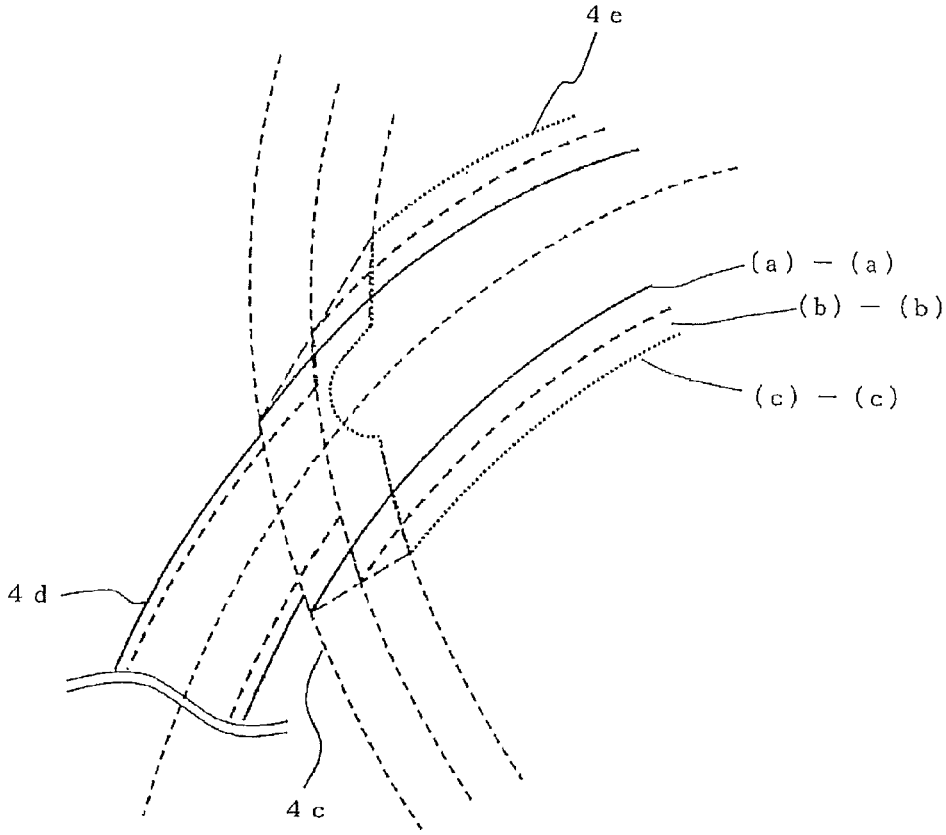
FIG. 15 is a schematic sectional view showing changes in blade thickness along the lines "a-a", "b-b", and "c-c" of the centrifugal fan of the third embodiment.
Figure 16:
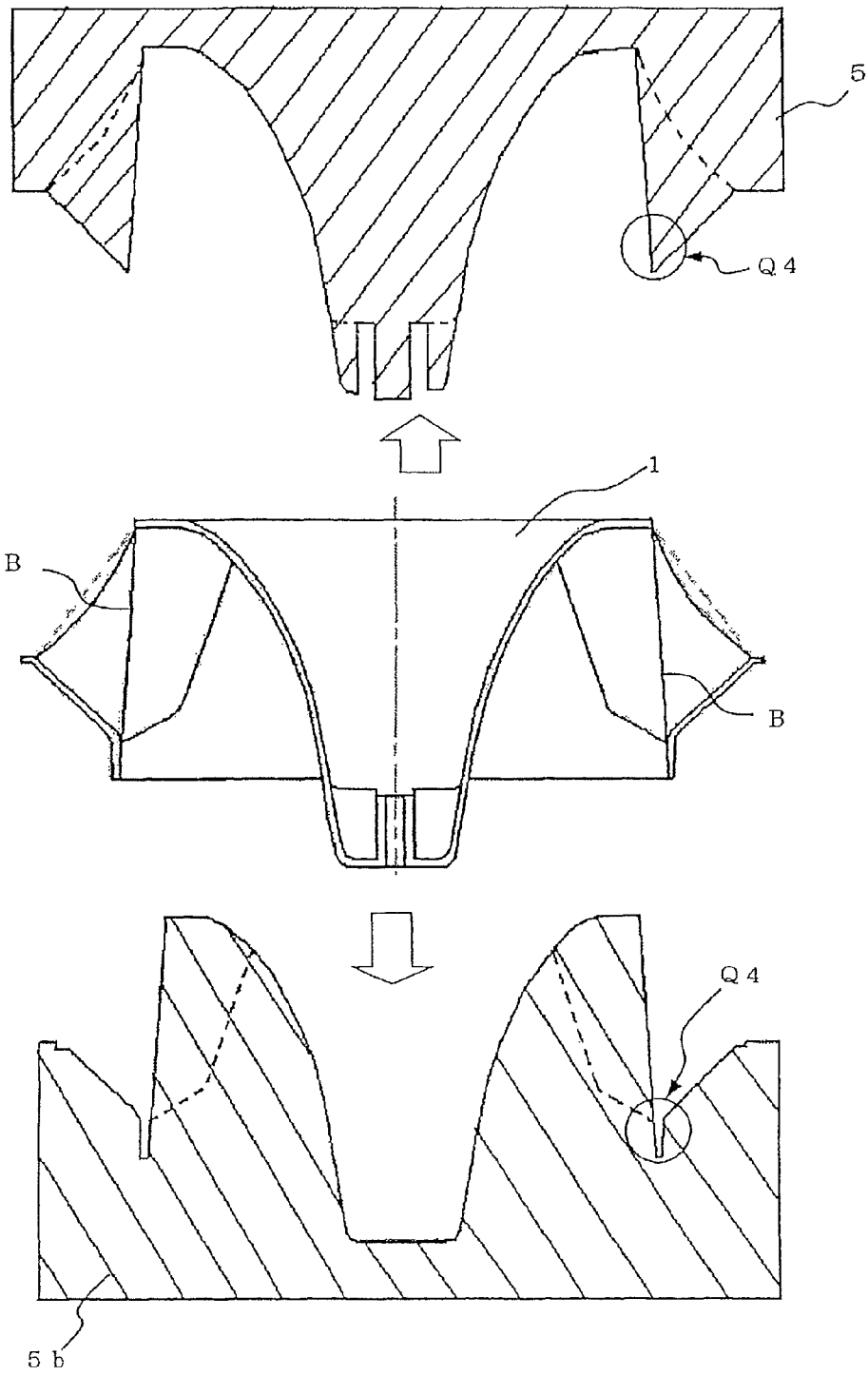
FIG. 16 is a schematic sectional view of forming molds during molding.

FIG. 10 is a perspective view of a centrifugal fan according to an embodiment of the present invention, with a side plate partly removed; FIG. 11 is a longitudinal sectional view of the centrifugal fan of FIG. 10 in which blades are projected on a common section together with a rotation axis; FIG. 12 is a plan view of the centrifugal fan of FIG. 10 viewed from the fan suction side; FIG. 13 is a horizontal sectional view of the blade along the line "a-a" of FIG. 10; FIG. 14 is a horizontal sectional view of the blade along the line "b-b" of FIG. 10; FIG. 15 is a schematic view stepwise showing changes in blade thicknesses t1 and t2 of the outer blade part 4*d* and the inner blade part 4*e* along the lines "a-a", "b-b", and "c-c" of FIG. 5; and FIG. 16 is a schematic sectional view of forming molds during molding. The same constitutions as that in the first and second embodiments are given the same characters.

In a plurality of the blades 4, as shown in FIG. 12, the blades 4 have a two-dimensional profile in that a blade sectional shape has the same warped line 4*s* indicating a center line of the blade thickness, in the direction of the rotation axis. Also, as shown in FIG. 11, it is the same as in the first and second embodiments that the blade outer diameter ϕDb2 and the blade inner diameter ϕDb1 gradually increase toward the side plate from the main plate.

On the other hand, at the position of the blade 4 opposing the main plate 2, the ring-shaped side plate 3 is provided for forming a fan internal guide path in that the side plate outer diameter ϕDs<the main plate outer diameter ϕDm=the blade rear edge main plate side outer diameter ϕDb2*m* is satisfied. Also, when character ϕDs1 denotes the diameter of the fan suction port around the rotation axis 0 at a side-plate suction end 3*d*, the main plate outer diameter Dm<the fan suction port diameter Ds1 holds, so that this relationship is opposite to that of the first and second embodiments.

Next, the blade rear edge 4*b* is located inside the fan from the blade-outlet representative line A, which is a straight line connecting between the blade rear-edge main plate side connection part 4*bm* and the blade rear-edge side plate side connection part 4*bs*, which are connection points between the blade 4 and the main plate 2 and between the blade 4 and the side plate 3, respectively, and the blade rear edge 4*b* also has a concave shape that increasingly inclines at least toward outside of the fan relative to the blade-outlet inclination reference line AO which is a straight line passing the blade rear-edge main plate side connection part 4*bm* in parallel with the rotation axis 0.

Furthermore, when characters ϕDb2*m* and ϕDas1 denote diameters about the rotation axis at the blade rear-edge main plate side connection part 4*bm* and the blade front-edge side-plate side connection part 4*as*, respectively, at least, ϕDb2*m*<ϕDas1 is satisfied, so that the diameter gradually increases toward the side plate from the main plate. Furthermore, when character ϕDs1 denotes a diameter of the suction port which is a diameter about the rotation axis at the side-plate suction end 3*d*, ϕDas1<ϕDs1 is satisfied. By satisfying these relations, release of the forming molds is made possible when the centrifugal fan 1 according to the embodiment is manufactured by integral molding as described later.

Furthermore, the blade parting line B is formed on a blade plane that is passing through the blade rear-edge main plate side connection part 4*bm* and the blade front-edge side-plate side connection part 4*as* and has a diameter gradually increasing toward the side plate 3 from the main plate 2 in the direction of the rotation axis at least within the range between the blade rear-edge main plate side diameter ϕDm and the blade front-edge side-plate side diameter ϕDas1. As is apparent from the comparison between FIG. 5 and FIG. 11, this blade parting line B has inclination opposite to that of the first and second embodiments.

As shown in FIG. 13, on the line "a-a", the step 4*c* between the outer blade part 4*d* and the inner blade part 4*e* is not so large, while in the section along the line "b-b" shown in FIG. 14, the step 4*c* between them is larger than that of FIG. 13.

As shown in FIG. 15, the thickness t1 of the outer blade part 4*d* on the outer circumferential side of the blade parting line B gradually increases from the main plate 2 toward the side plate 3 (i.e., from the line "c-c" toward the line "a-a"), while in contrast, the thickness t2 of the inner blade part 4*e* inside the blade parting line B gradually decreases from the main plate 2 toward the side plate 3. In the direction of the rotation axis, on the condition of at least the thickness t1 of the outer blade part 4*d*<the thickness t2 of the inner blade part 4*e*, the blade is formed so that the height h of the step 4*c*, formed by the blade thickness difference between the inner blade part 4*e* and the outer blade part 4*d* along the blade parting line B, gradually increases toward the main plate 2 from the side plate 3.

As described above, according to the third embodiment, the blade parting line B is configured so that the distance of the step 4*c* existing along the blade parting line B to the rotation axis 0 increases toward the line "a-a" from the line "c-c", inversely to that in the first and second embodiments.

By forming the centrifugal fan 1 in such a manner, in the same way as in the first and second embodiments, the airflow concentration to the main plate side or to the side plate side is avoided, differently from the case in a conventional centrifugal fan with the straight blade rear edge 4*b*, so that pressure changes are suppressed on the wall on the side of the side plate or the main plate, reducing noise.

Also, an eddy G1 is generated with the step 4*c* to have a negative pressure during air-flowing from the inner blade part 4*e* toward the outer blade part 4*d*, so that air comes to flow along the surface of the outer blade part 4*d*, reducing the air-flow separation at the outer blade part 4*d*, which will be produced without the step 4*c*, to suppress air-flow turbulence, and the noise can be further reduced.

Furthermore, as shown in FIG. 11, the blade 4 is formed so that the blade parting line B is gradually increased in its diameter Db3 toward the side plate 3 from the main plate 2 in the direction of the rotation axis; the thickness of the outer blade part 4*d* gradually increases in the direction of the rotation axis; and the thickness of the inner blade part 4*e* gradually decreases. Simultaneously, the main plate diameter Dm<the fan suction port diameter Ds1. Hence, as shown in FIG. 16, during molding, a work piece can be separated from forming molds 5*a* and 5*b* by the forming molds in the direction of the rotation axis (upward and downward).

In a conventional twisted blade shape (skew vane) in that the blade on the main plate side and the side plate side is offset in the rotation direction, a slide forming mold capable of moving in a lateral direction in addition to the direction of the rotation axis is necessary, requiring a complicated mold structure. Whereas, in the centrifugal fan according to the third embodiment, the main plate, the blade part of the blade and the side plate can be integrally formed easily, so that the slide forming mold is not necessary, simplifying the mold structure and reducing forming defect. Therefore, the reliability is improved, suppressing scraps due to patchworks.

Consequently, a centrifugal fan with low noise and high reliability in production as well as environmentally benignity can be provided.

By configuring the centrifugal fan in such a manner, noise can be reduced; however, if an acute-side angle (an inclination angle β1) is excessively large, which is defined by the blade-outlet representative line A that is a straight line connecting between the blade rear-edge main plate side connection part 4*bm* and the blade rear-edge side plate side connection part 4*bs* shown in FIG. 11 and the blade-outlet inclination reference line AO that is a straight line passing through the blade rear-edge main plate side connection part 4*bm* in parallel with the rotation axis as shown in FIG. 11, the difference in chord length L between the side plate side and the main plate side is excessively large, so that the blowing-out airflow on the side plate side V2 tends to relatively increase; conversely, if the inclination angle β1 is excessively small, the blowing-out airflow on main plate side V1 tends to relatively increase, so that the blowing-out airflow V0 becomes rather a biased flow, increasing noise originated from the high-speed airflow region.

During forming the blade rear edge 4*b* in a concave shape, if a maximal curved part 4*bd*, which is located at a maximal distance between the blade rear edge 4*b* and the blade-outlet representative line A that is a straight line connecting between the blade rear-edge main plate side connection part 4*bm* and the blade rear-edge side plate side connection part 4*bs*, is excessively on the fan inner circumference side, so that the concave shape is excessively deep, the difference between angles of the blowing-out airflows on the main plate side and the side-plate side of the blade rear edge 4*b* is excessively large, so that the airflows interfere with each other when meeting, deteriorating the noise. Also, the increase in total pressure is reduced due to the reduction in surface area of the blade against the shape effect of the rear-edge part, so that the rotation speed must be increased to keep the airflow rate, deteriorating the noise due to the higher air speed on the blade surface.

Furthermore, if the main plate outer diameter Dm is excessively small relative to the fan suction port diameter Ds1, the increase in total pressure at the blade 4 is reduced, so that there is the danger of deteriorating air-blowing characteristics.

When the fan motor is arranged on the fan suction side as shown in FIG. 11, if the fan motor is arranged in the vicinity of the fan suction port 1*a*, the fan suction area is reduced, deteriorating air-blowing characteristics due to the pressure loss, so that the fan motor must be arranged to be kept away from the fan suction port 1*a*. However, if the main plate 2 and the boss 2*a* are arranged inside the fan as in the conventional ones, the slender rotation shaft 0 of the fan motor must be extended and fixed, so that a load point is placed apart from the fan motor. This may damage the fan motor caused by a high-load due to load concentration on the root of the shaft. Hence, according to the embodiment of the present invention, the main plate boss 2*a* is protruded outside the fan from the fan suction port 1*a* toward the fan motor side, so that the load point is shifted toward the fan motor side for reducing the load to the fan motor, enabling a high-quality centrifugal fan without failure to be obtained.

Then, there are optimal ranges in the inclination angle β1, the depth of the rear-edge concave shape, the ratio Ds1/Dm between the main plate outer diameter Dm and the fan suction port diameter Ds1, and the ratio Di/Ds1 between the fan suction port diameter Ds1 and the protruding main plate boss diameter Di at the fan suction port.

Figure 17:
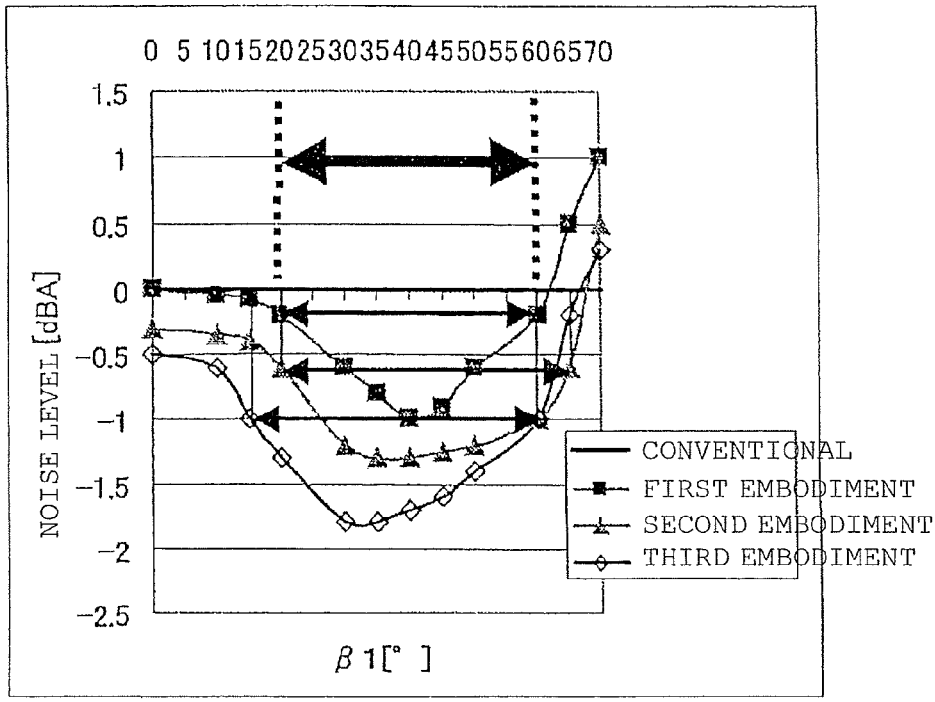
FIG. 17 is a relationship diagram between an inclination angle β1 and a noise level at the same flow rate.

FIG. 17 shows the relationship between the inclination angle β1 and the noise level at the same flow rate. As shown in FIG. 17, if the inclination angle β1 ranges from 15 to 65°, the difference between the flow speeds V1 and V2, respectively on the side plate side and main plate side of the flowing-out flow V0 is small, and the interference when meeting is small as well, and changes in noise level are small, so that the noise level is reduced by 2 dB at most in comparison with the conventional centrifugal fan having the straight blade rear edge.

Furthermore, FIG. 17 simultaneously shows the relationship between the inclination angle β1 in the centrifugal fan 1 according to the first and second embodiments and the noise level at the same flow rate.

As shown in FIG. 17, in the centrifugal fan of the first embodiment, if the angle ranges at least from 20 to 60°, the noise level is reduced by 1 dB at most in comparison with the conventional centrifugal fan having the straight blade rear edge; in the centrifugal fan of the second embodiment, if the angle ranges at least from 20 to 65°, the noise level is further reduced by 1 dB at most in comparison with the centrifugal fan of the first embodiment.

As described above, if the inclination angle β1 ranges at least from 20 to 60°, a centrifugal fan can be obtained with low noise.

Figure 18:
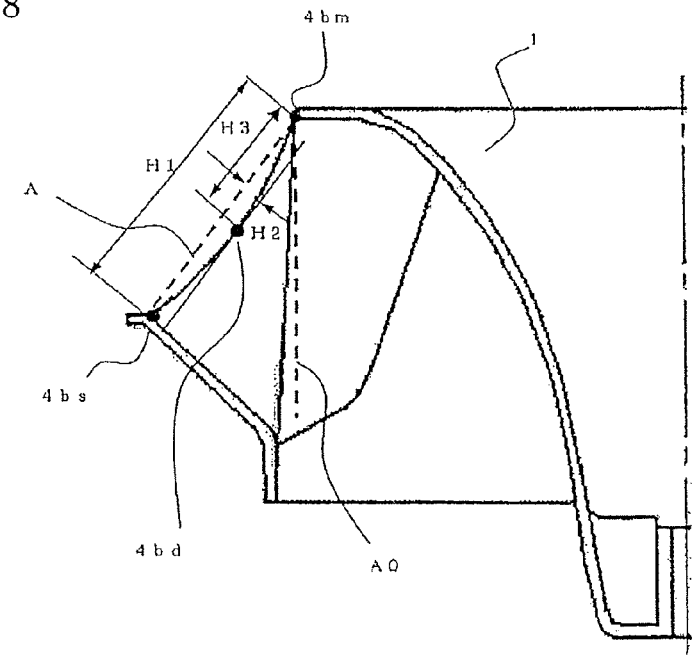
FIG. 18 is a partial enlarged view of a blade rear edge.
Figure 19:
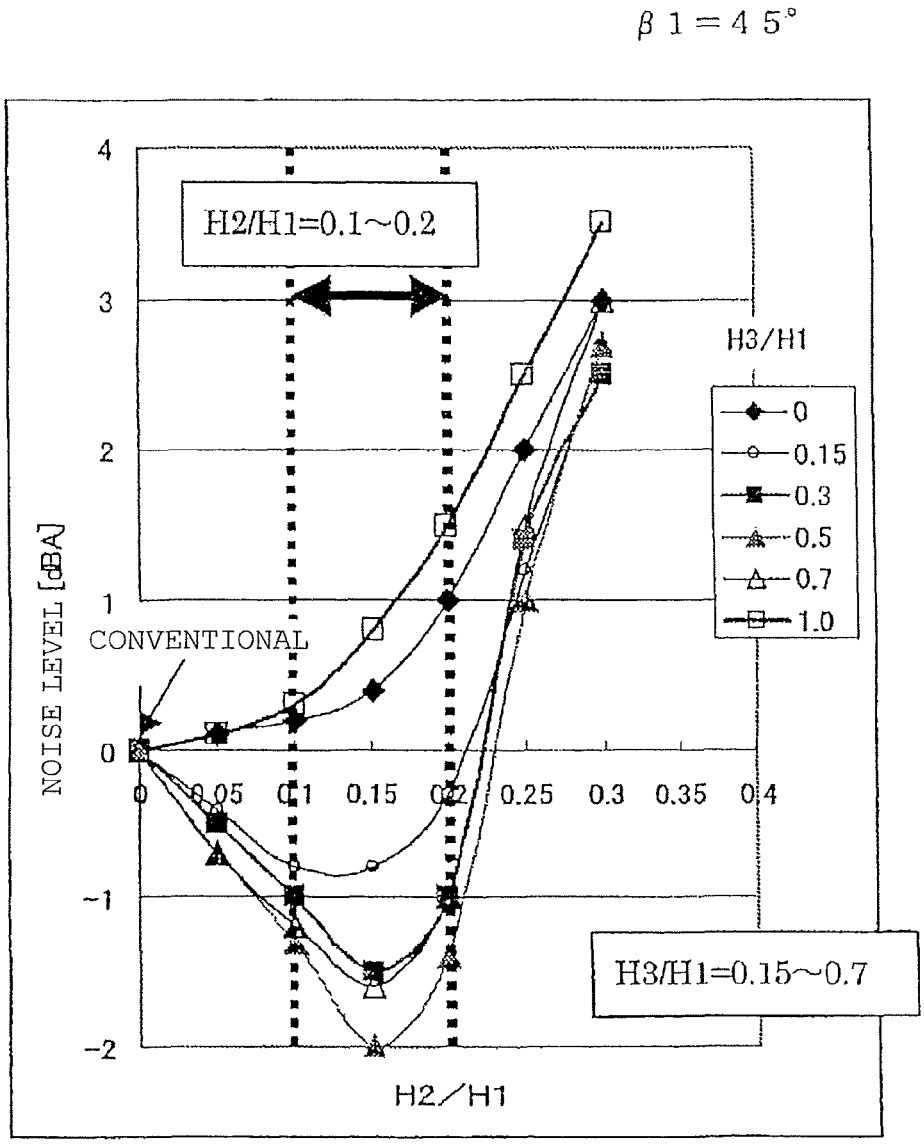
FIG. 19 is a relationship diagram of the ratio H2/H1, where H1 is the length of a blade-outlet representative line A of a concave blade rear-edge and H2 is the maximal curvature height; and the ratio H3/H1, where H3 is the maximal curvature exit height and H1 is the length of the blade-outlet representative line A, to the noise level.

FIG. 19 shows the relationship of the noise level to the ratio H2/H1 and the ratio H3/H1, where H1 is the length of the blade-outlet representative line A that is a straight line connecting between the concave blade rear-edge main plate side connection part 4*bm* and the blade rear-edge side plate side connection part 4*bs*; H2 is the distance of the straight line (=maximal curvature height) passing through the point 4*bd*, where the distance is maximal between the blade-outlet representative line A and a point on the concave blade rear edge 4*b*, perpendicularly to the blade-outlet representative line A; and H3 is the distance (maximal curvature exit height) between the point 1*bd*, which is the intersection point of the blade-outlet representative line A and its perpendicular line passing through the point 4*bd*, and the blade rear-edge main plate side connection part 4*bm*, as shown in FIG. 18 of the partial enlarged view of the blade rear edge. Incidentally, the center line of each graph is shown for the inclination angle β1=45°.

From FIG. 19, in the range of H2/H1=0.1 to 0.2 and H3/H1=0.15 to 0.7, a centrifugal fan with lower noise than that in a conventional one can be consequently provided, even in consideration of the low noise effect of 0.5 to 2 dBA at the inclination angles β1 of 20 to 60°.

Figure 20:
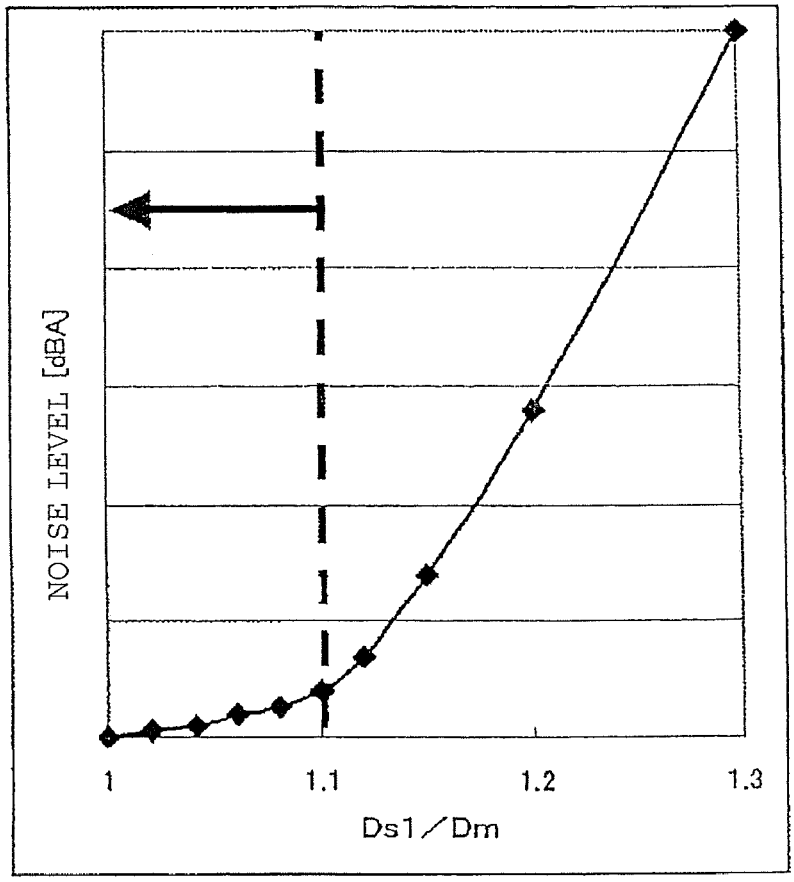
FIG. 20 is a relationship diagram of the ratio Ds1/Dm to the noise level at the same flow rate, where Ds1 is the fan suction port diameter and Dm is the main plate outer diameter.

Furthermore, FIG. 20 is a drawing showing the relationship of the ratio Ds1/Dm, where Ds1 is the fan suction port diameter and Dm is the main plate outer diameter to the noise level at the same flow rate, in the centrifugal fan 1 according to the third embodiment.

As shown in FIG. 20, if the ratio Ds1/Dm is more than 1.10, the length of the internal fan guide path, in which the blades 4 is surrounded by the side plate 3, the main plate 2, becomes excessively small, so that the increase in total pressure is reduced and the noise level is sharply deteriorated because of the increase in rotation speed for keeping the flow rate. Also, for integral forming, if the diameters of the main plate 2 and the fan suction port Ds1 are the same, forming molds are hardly released during the integral forming, so that the ratio Ds1/Dm is preferably 1.02 or more. This tendency is the same as in the centrifugal fan of the first and second embodiments.

As a result, when the ratio Ds1/Dm ranges from 1.02 to 1.10, the deterioration in noise is suppressed and the manufacturing reliability can be secured without problems during forming, so that a low-noise and high-quality centrifugal fan can be provided.

Figure 21:
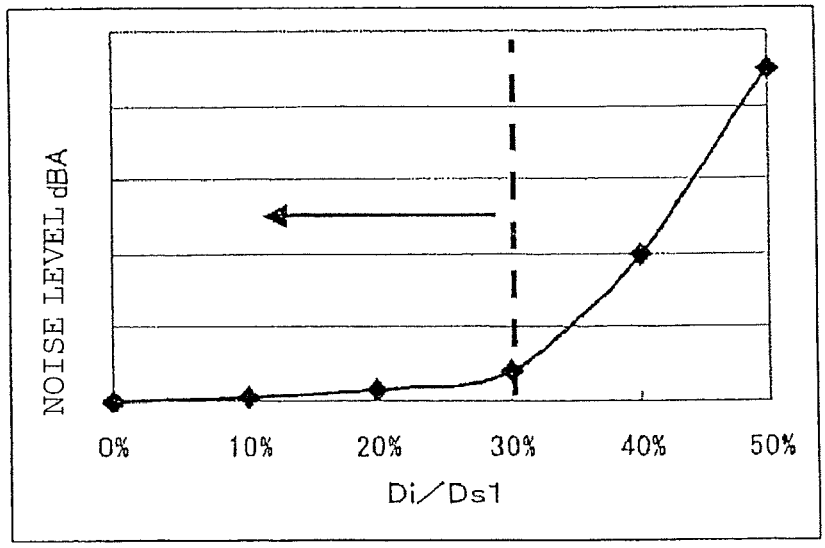
FIG. 21 is a relationship diagram of the ratio Di/Ds1, where Ds1 is the fan suction port diameter and Di is the main plate diameter, at the fan suction port 1*a*, to the noise level, at the same flow rate.

FIG. 21 is a drawing showing the relationship of the ratio Di/Ds1 where Ds1 is the fan suction port diameter and Di is the main plate diameter at the fan suction port 1*a*, to the noise level at the same flow rate, in the centrifugal fan 1 according to the third embodiment.

As shown in FIG. 21, when the ratio Di/Ds1 is 30% or less, the fan suction port area can be sufficiently secured, so that variation of the noise level can be maintained small and the load applied to the rotation shaft of the fan motor 7 can be reduced. If the main plate diameter Di at the fan suction port 1*a* is smaller than the rotation shaft diameter of the fan motor 7, the load is concentrated on the main plate 2 so as to damage the fan. Therefore, it is obvious to make the main plate diameter Di at least larger than the rotation shaft diameter.

As a result, since the load point is shifted toward the fan motor so as to reduce the load applied to the fan motor, the failure of the fan motor is eliminated and changes in noise can be suppressed, obtaining a low-noise and high-quality centrifugal fan.

Fourth Embodiment

A centrifugal fan according to a fourth embodiment of the present invention will be described below with reference to FIGS. 22 and 23. Main constitution and corresponding characters of the centrifugal fan are shown in common with the first to third embodiments.

Figure 22:
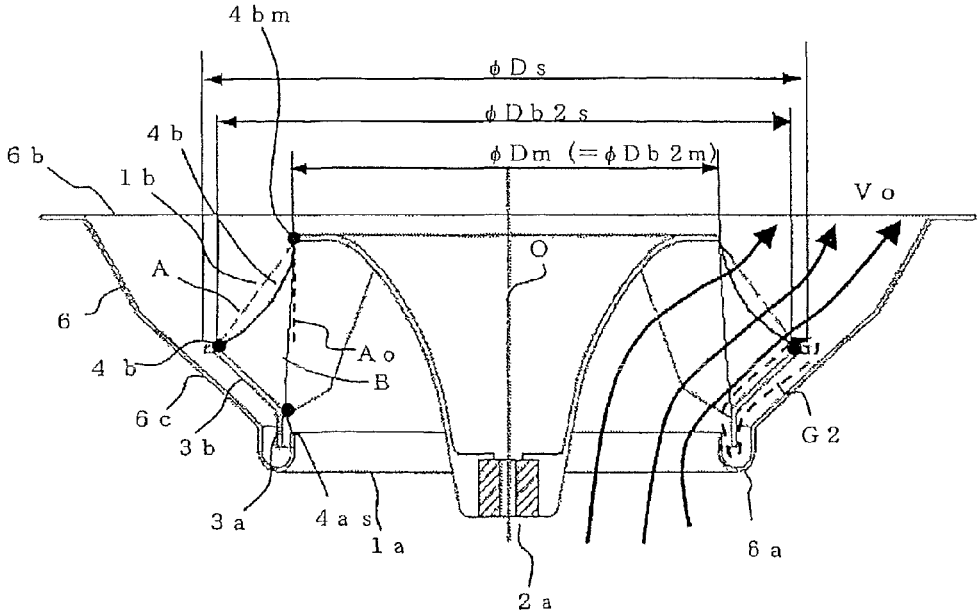
FIG. 22 is a longitudinal sectional view of a centrifugal fan and an air guide plate including the rotation axis according to a fourth embodiment.

FIG. 22 is a longitudinal sectional view of the centrifugal fan and an air guide plate including the rotation axis according to the embodiment; FIG. 23 is a perspective view of the guide plate of FIG. 22.

Figure 23:
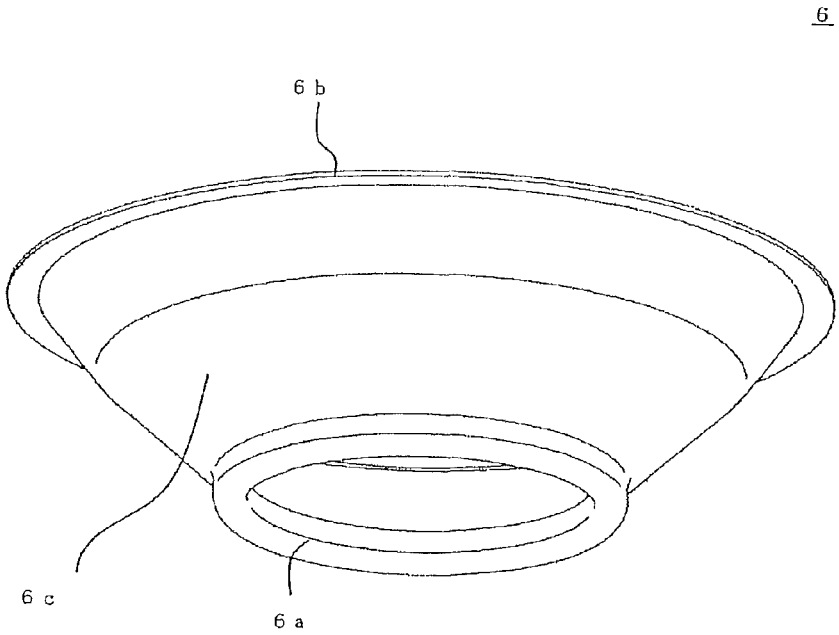
FIG. 23 is a perspective view of the air guide plate of the fourth embodiment.

As shown in FIGS. 22 and 23, the centrifugal fan 1 of the fourth embodiment is further provided with a straight-tubular side-plate suction part 3*a* arranged in the side plate 3 for constituting the fan suction port. The side-plate suction part 3*a* is arranged toward the fan suction side from the side plate 3 in the vicinity of the blade front-edge side plate side connection part 4*as*. At a position in the vicinity of the side plate 3 of the centrifugal fan 1 and apart from the side plate 3 by a predetermined distance, a fan flowing-out airflow guide plate 6 is arranged which is integrally formed of a bell-mouth 6*a* formed to cover the side-plate suction part 3*a* substantially in parallel therewith, and the air guide part 6*c* is formed along the surface of an air guide wall 3*b* substantially in parallel therewith for guiding the blowing-out airflow V0 of the centrifugal fan 1 outside from an air guide blowing-out port 6*b*. The air guide part 6*c* gradually expands toward the air guide blowing-out port 6*b* from the fan blow-out port 1*b*.

By forming the centrifugal fan 1 and the fan blowing-out guide plate 6 in such a manner, during blowing-out in the direction substantially perpendicular to the blade rear edge 4*b*, the airflow speed on the side-plate side, on which with a blade chord length L is larger than that on the main plate side is higher than that on the main plate side. However, by forming the blade rear edge 4*b* in a concave shape, the airflow is substantially concentrated rather on the center after blowing-out from the fan blow-out port 1*b* so as to blow-out in the oblique direction. Further, since the air path area of the fan blowing-out guide plate 6 gradually expands so as to be formed along the surface of the side plate 3 in substantially parallel therewith, the flow speed of the fan blowing-out flow can be gradually reduced, stabilizing the airflow. Thereby, even when an obstacle, such as a blowing-out grill, is arranged on the downstream side of the air guide blowing-out port 6*b*, the noise level can be reduced while the air direction can be easily controlled.

Also, at the position in the vicinity of the side plate 3 of the centrifugal fan 1 and apart from the side plate 3 by a predetermined distance, the fan blowing-out airflow guide plate 6 is arranged, which is integrally formed of the bell-mouth 6*a* formed to cover the side-plate suction part 3*a* substantially in parallel therewith, and the air guide part 6*c* formed along the surface of an air guide wall 3*b* constituting the air guide part inside the fan substantially in parallel therewith, so that an airflow G2, inversely circulating through the space between the side plate 3 and the fan blowing-out airflow guide plate 6 toward the fan suction port 1*a* from the fan blow-out port 1*b*, can be suppressed so as to reduce the turbulence due to the airflow G2, enabling the noise level to be reduced.

In the fan blowing-out airflow guide plate 6, since the bell-mouth 6*a* and the air guide part 6*c* are integrally formed, one part count is only required, so that the assembled individual difference due to the displacement in a screwing process and a positioning process, which are otherwise required, is suppressed, enabling the unevenness of blowing characteristics to be reduced and facilitating assembling.

As a result, a low-noise, high-quality, and high reliable centrifugal fan capable of reducing the unevenness in blowing characteristics due to the assembled individual difference can be provided.

Fifth Embodiment

A centrifugal fan according to a fifth embodiment of the present invention will be described below with reference to FIGS. 24 to 27(A and B). Main constitution and corresponding characters of the centrifugal fan are shown in common with the first to fourth embodiments.

Figure 24:
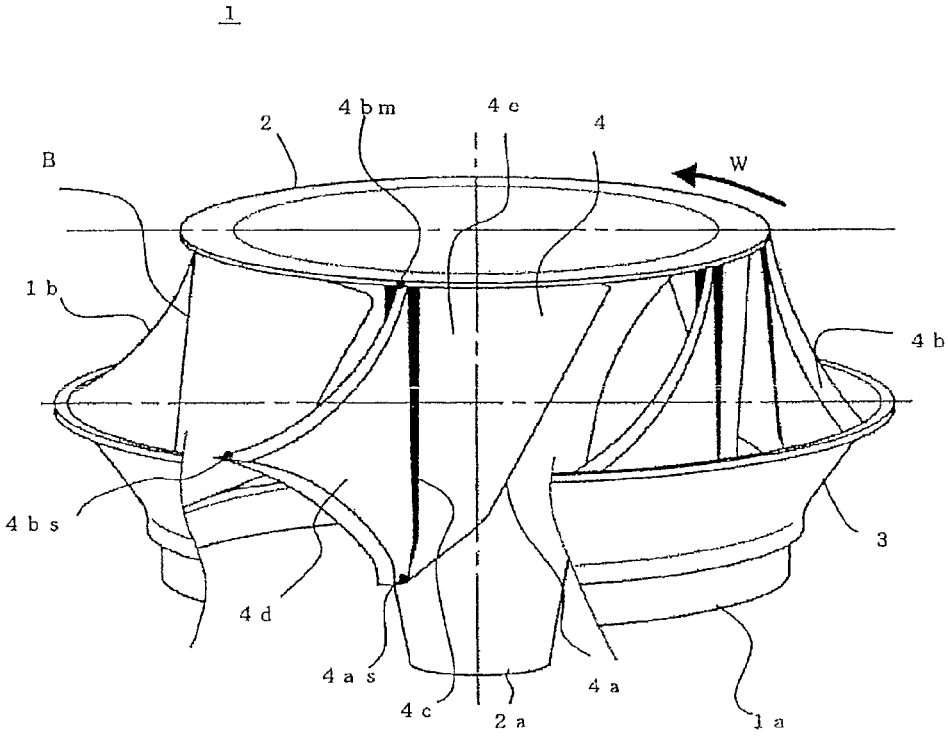
FIG. 24 is a perspective view of a centrifugal fan according to a fifth embodiment of the present invention.
Figure 25:
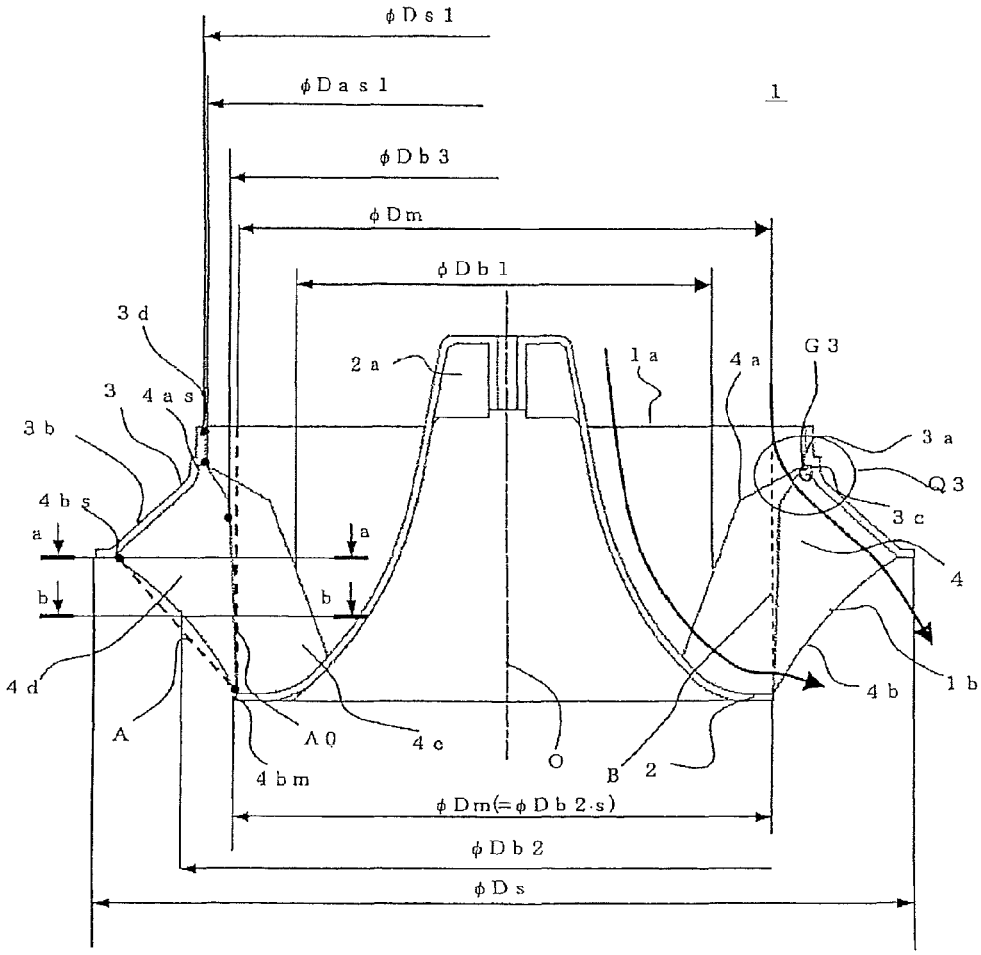
FIG. 25 is a longitudinal sectional projected drawing of the centrifugal fan of the fifth embodiment.
Figure 26:
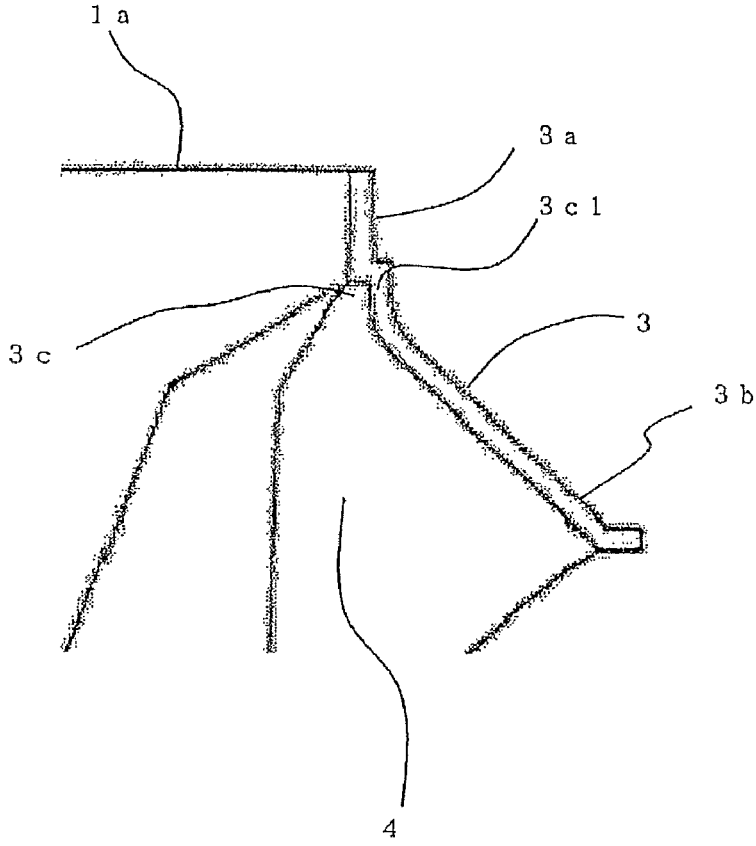
FIG. 26 is a partial enlarged view of vicinity of a side-plate concave part of the centrifugal fan of the fifth embodiment.

FIG. 24 is a perspective view of a centrifugal fan according to the embodiment of the present invention; FIG. 25 is a longitudinal sectional projected drawing of FIG. 23; and FIG. 26 is a partial enlarged view of a side-plate concave part 3*c* shown by circular mark Q2 of FIG. 25.

In a plurality of the blades 4, as shown in FIGS. 24 and 25, the blade 4 has a two-dimensional profile in that the warped line 4*s* indicating a center line of the blade thickness in the direction of the rotation axis has the same blade sectional shape in the same way as in FIG. 3. At a position of the blade 4 opposing the main plate 2, the ring-shaped side plate 3 is provided for forming a fan internal guide path in that the side plate outer diameter Ds<the main plate outer diameter ϕDm=the blade rear edge main plate side outer diameter ϕDb2*m* is satisfied. The main plate outer diameter ϕD m<the fan suction port diameter ϕDs1 is satisfied, too. This relationship is the same as in the third and fourth embodiments.

Furthermore, it is the same as in the third and fourth embodiments that the outer diameter ϕDb2 and the inner diameter ϕDb1 of the blade 4 increase toward the side plate 3 from the main plate 2 in the direction of the rotation axis and the blade rear edge 4*b* is formed in a concave curving shape. Also as will be described later, the centrifugal fan according to the embodiment can be easily formed integrally by devising the structure. In this case, the relationship of ϕDb2*m*<ϕDas1<ϕDs1 is satisfied, where ϕDb2*m* is the blade rear edge main plate side outer diameter ϕDas1 is the blade front-edge side-plate side diameter, and ϕDs1 is the fan suction port diameter which is the diameter at the side-plate suction end 3*d* about the rotation axis.

On the other hand, the step 4*c* provided in the blade 4, as shown in FIG. 25, is formed in combination with two straight lines, differently from in FIG. 11 in this respect. The step 4*c* passes through the blade rear-edge main plate side connection part 4*bm* and the blade front-edge side-plate side connection part 4*as*, and its diameter gradually increases toward the side plate 3 from the main plate 2 in the direction of the rotation axis on the condition of at least the main plate outer diameter ϕDm<the blade front-edge side-plate side diameter ϕDas1. FIG. 25 shows the step 4*c* of the combination of two straight lines; however, it is not limited to this, so that if the above condition is satisfied, the step 4*c* may be a curved line as well as the combination of straight lines.

The thickness t1 of the outer blade part 4*d* on the outer circumferential side of the step 4*c* gradually increases from the main plate 2 toward the side plate 3, while the thickness t2 of the inner blade part 4*e* inside from the blade parting line B gradually decreases from the main plate 2 toward the side plate 3. Furthermore, in the direction of the rotation axis, on the condition of at least the thickness t1 of the outer blade part 4*d*<the thickness t2 of the inner blade part 4*e*, the step 4*c* is formed by the blade thickness difference between the inner blade part 4*e* and the outer blade part 4*d*. The blade is formed so that the height h of the step 4*c* gradually increases toward the main plate 2 from the side plate 3.

Figure 27A:
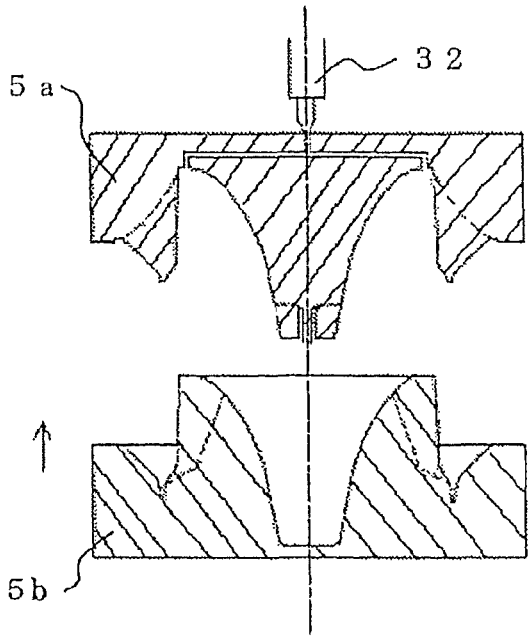
FIG. 27A is an explanatory view of the fabrication steps of the centrifugal fan of the fifth embodiment.
Figure 27A:
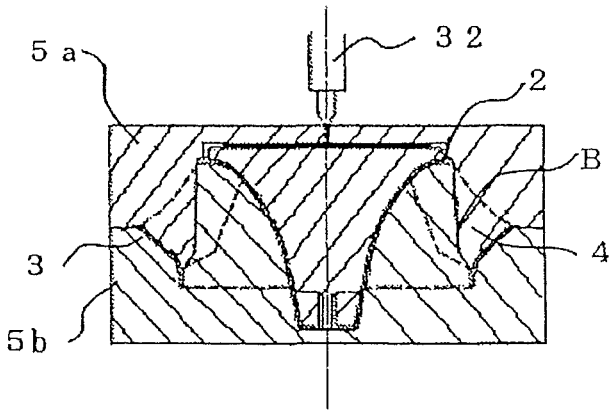
Figure 27A:
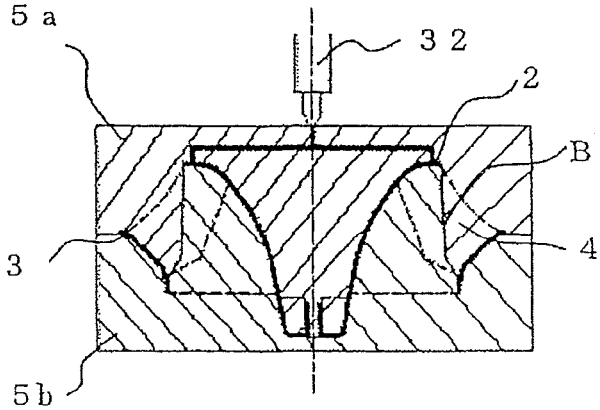
Figure 27B:
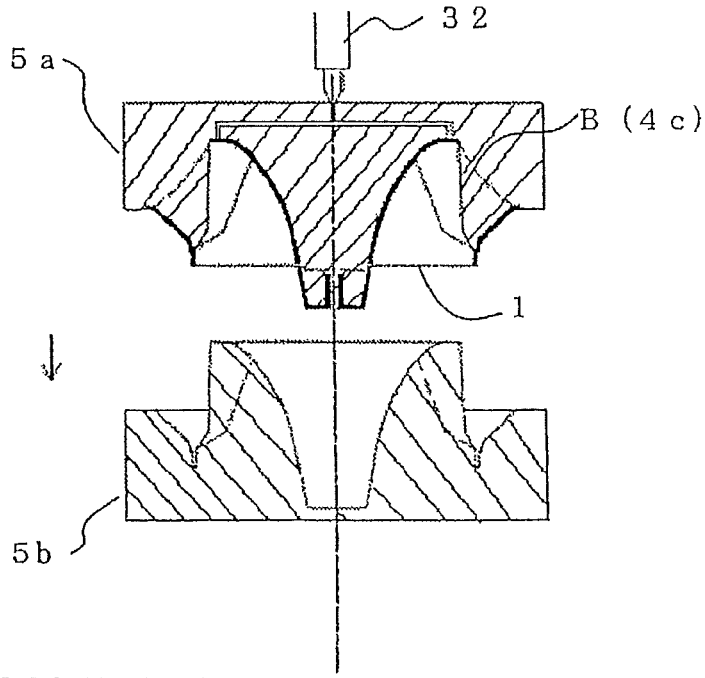
FIG. 27B is an explanatory view of the fabrication steps of the centrifugal fan of the fifth embodiment.
Figure 27B:
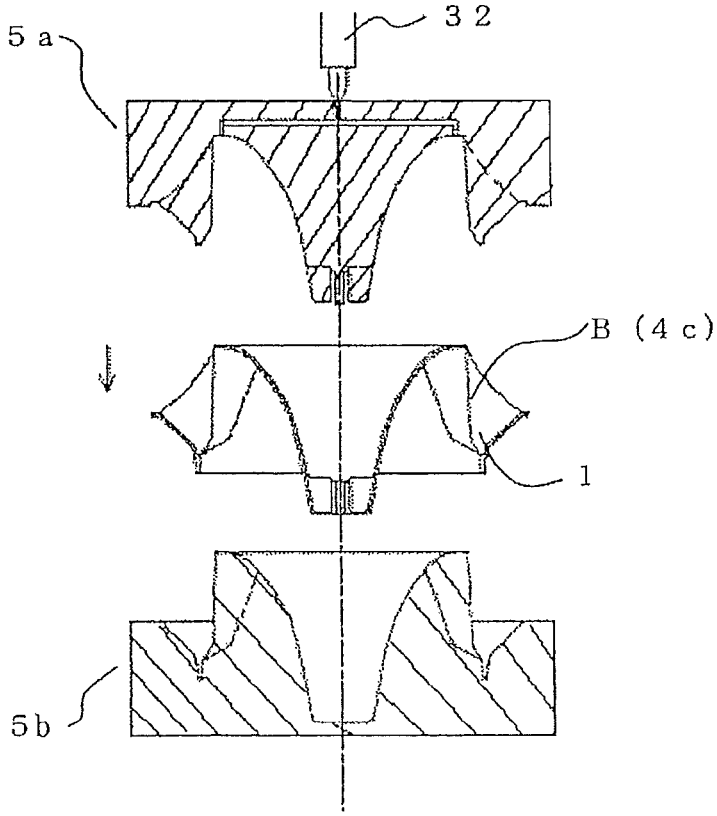

FIGS. 27A and 27B are drawings showing each step during molding. The centrifugal fan of the fifth embodiment is molded through the steps of (a) a forming mold moving step, (b) a resin infusion step, and (c) a resin cooling step as shown in FIG. 27A, and also (d) a mold releasing step and (e) a molded product picking out step are shown in FIG. 27B.

At (a) the forming mold moving step, toward one forming mold 5*a*, the other forming mold 5*b* is moved to come in contact with it. The forming mold 5*a* is provided with an infusion nozzle 32 fixed for infusing a thermoplastic resin such as ABS, AS, PP, and PS. At (b) the resin infusion step, a clearance formed between the forming molds 5*a* and 5*b* in close contact is filled with the resin via the infusion nozzle 32, so that the resin flows in the boss 2*a* from the main plate 2, and in the side plate 3 from the main plate 2 via the blades 4. Then, at (c) the resin cooling step, the forming molds are cooled so as to form the centrifugal fan 1. Thereafter, at (d) the mold releasing step, the forming mold 5*b* is separated from the forming mold 5*a*. At this time, on the close contact surface between the forming mold 5*a* located on the blades of the centrifugal fan 1 and the forming mold 5*b*, the blade parting line B, i.e., the step 4*c*, is formed. At (e) the molded product picking out step, a molded product that is the centrifugal fan 1 is removed from the forming mold 5*a* so as to complete the molding.

As described above, by forming the step 4*c*, when molding, the forming mold 5*b* can be moved toward the direction of the side plate 3 in the rotation axis direction on the inner circumferential side from the step 4*c*, and the forming mold 5*a* can be moved toward the direction of the main plate 2 in the rotation axis direction on the outer circumferential side, so that the work piece can be released, as shown in the schematic drawings of forming molds of FIGS. 27A and 27B. Therefore, a slide mold capable of moving in the direction perpendicular to the rotation axis can be eliminated, so that the blades 4, the main plate 2, and the side plate 3 can be integrally formed, simplifying the molding method. Thereby, the molding failure is hardly generated, improving the reliability. Also, scraps can be suppressed by patchwork so as to save materials in favor of environment.

Furthermore, in the centrifugal fan 1 of the fifth embodiment, as shown in FIGS. 25 and 26, a connection part 3*c*, in which the inner diameter of a suction side end portion of the air guide wall 3*b* is larger than that of the side-plate suction part 3*a* is formed on the suction side of the side plate 3. By forming the connection part 3*c* in such a manner, an eddy G3 is generated at the connection part 3*c* so as to have a negative pressure, so that the airflow flowing in from the side-plate suction part 3*a* flows along the air guide wall 3*b* so as to prevent separation, enabling the noise level to be further reduced. Also, the connection part 3*c* is provided with a plane 3*c*1 substantially perpendicular to the rotation axis, junction surfaces 5*a*1 and 5*b*1, corresponding to the connection part 3*c* of the upper and lower forming molds 5*a* and 5*b* shown in FIGS. 27A and 27B, do not have an acute angle unlike in circular mark Q1 of FIG. 16 in the third embodiment. Therefore even when continuously molding, clipped edges of the mold are hardly generated and the mold is hardly damaged, reducing the number of additional mold productions to save resources.

As a result, the prevention of the centrifugal fan damage during transportation enables packaging materials to be reduced, improving transportation quality, and operability in recycling is improved due to easiness in assembling/disassembling. Also, the blades, the main plate, and the side plate can be integrally formed, simplifying the molding method, so that the molding failure is hardly generated, improving the reliability. Thereby, scraps can be suppressed by patchwork so as to save materials in favor of environment.

Sixth Embodiment

An air conditioner according to a sixth embodiment of the present invention will be described below with reference to FIGS. 28 to 31. Main constitution and corresponding characters of the centrifugal fan mounted on the air conditioner are shown in common with the first to fifth embodiments.

Figure 28:
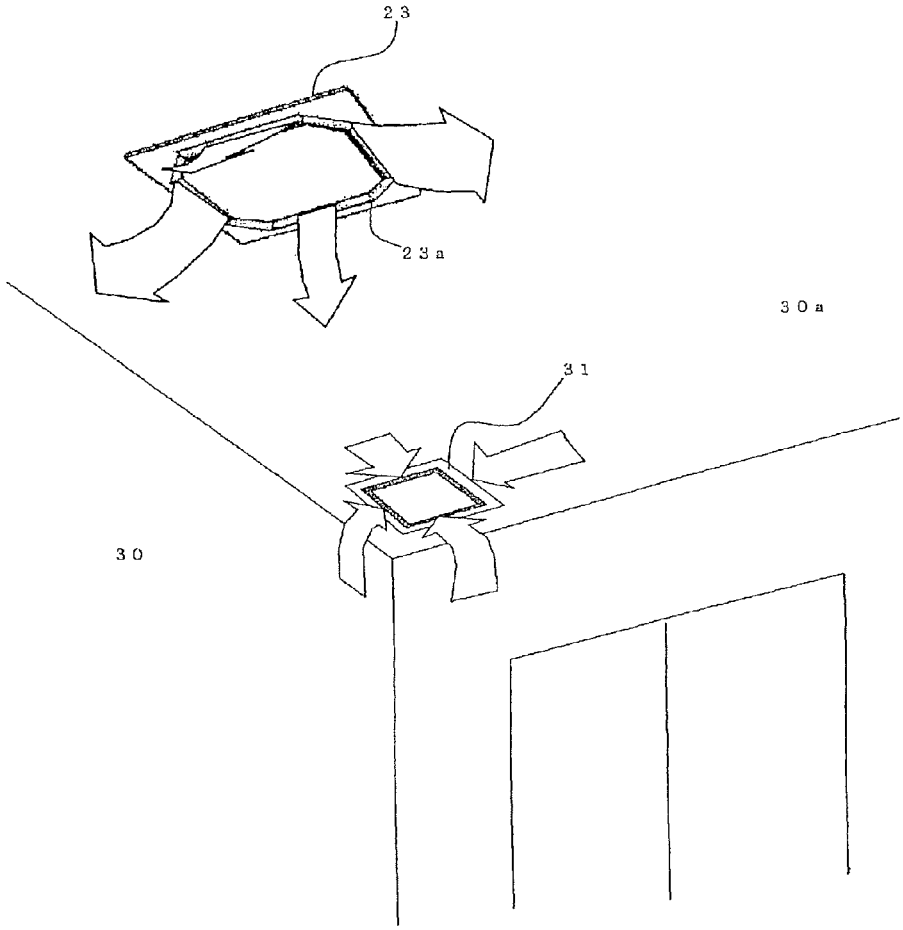
FIG. 28 is a drawing of an air conditioner according to a sixth embodiment showing its installed state viewed from a room.
Figure 29:
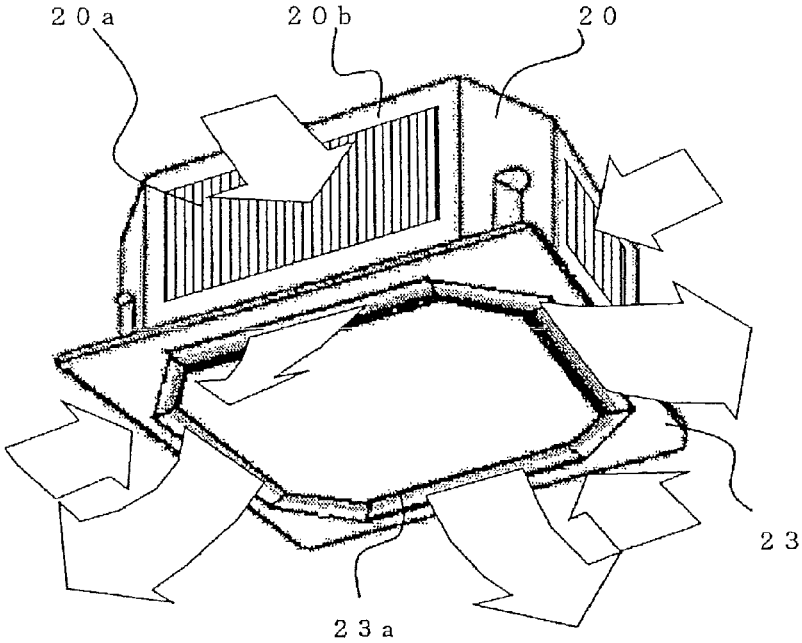
FIG. 29 is a perspective view of an air conditioner body according to the sixth embodiment.
Figure 30:
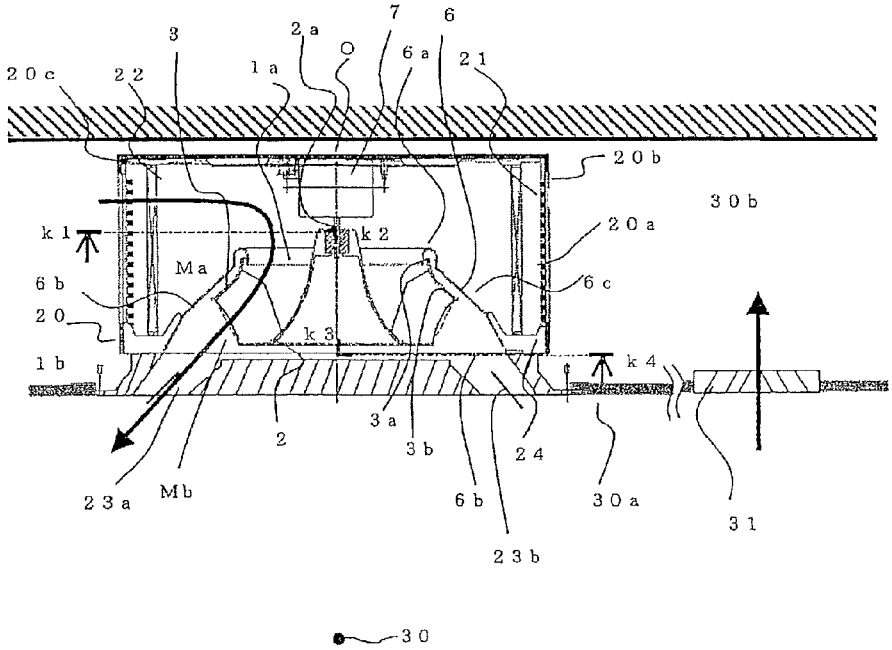
FIG. 30 is a longitudinal sectional view of the air conditioner of the sixth embodiment.

FIG. 28 is an example of an air conditioner according to an embodiment of the present invention, showing its installation state viewed from a room; FIG. 29 is a perspective view of an air conditioner body; FIG. 30 is a longitudinal sectional view of the air conditioner of FIG. 29; and FIG. 31 is a horizontal sectional view along the section reference line "k1-k4" of FIG. 30.

In FIGS. 28 and 30, at a position apart from a ceiling panel 23 of a ceiling 30*a*, a ceiling suction port 31 is provided for sucking room air in a room 30 toward a loft 30*b*, and on the bottom of an air conditioner body 20 arranged in the loft 30*b*, the ceiling panel 23 faces the ceiling 30*a* and the room 30.

Figure 31:
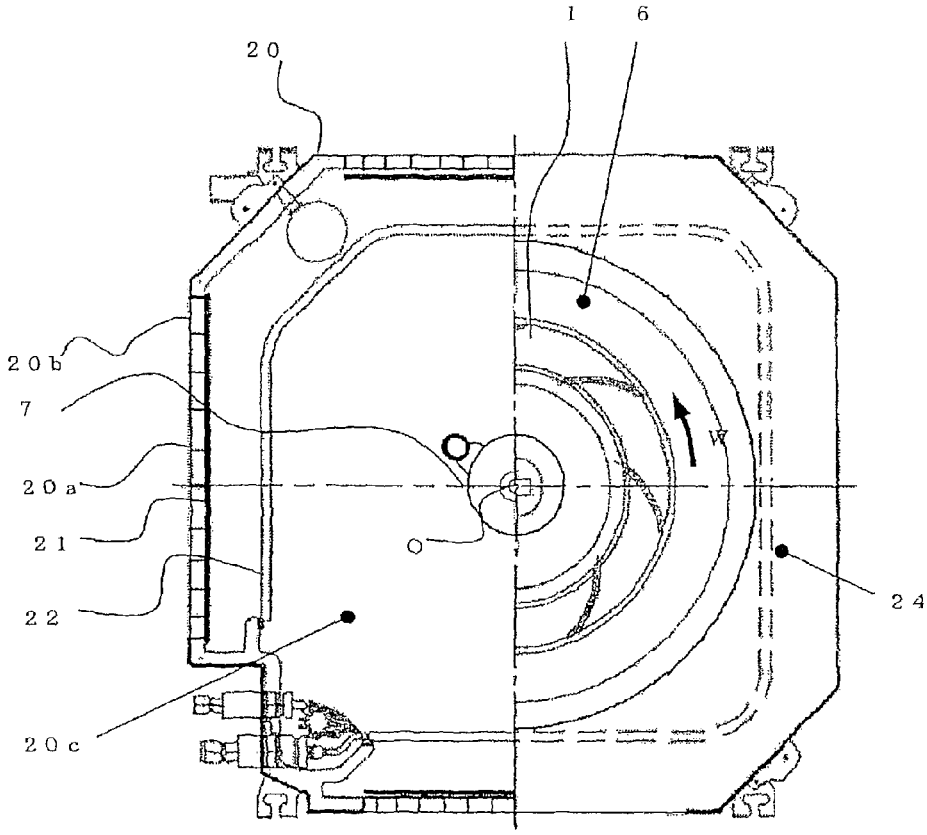
FIG. 31 is a horizontal sectional view along the section reference line "k1-k4" of FIG. 28 of the sixth embodiment.

In FIGS. 29 to 31, a body side wall 20*b* of the air conditioner body 20 is provided with a body suction port 20*a*; on the body suction port 20*a*, a dust filter 21 is arranged; and on the rear of the body suction port 20*a*, a substantially quadrangular heat exchanger 22 is erected as shown in FIG. 24. At a position in the vicinity of the side plate 3 of the centrifugal fan 1 and apart from the side plate 3 by a predetermined distance, the airflow guide plate 6 is arranged which is integrally formed of the bell-mouth 6*a* formed to separate a fan suction airflow path Ma from a blowing-out airflow path Mb and to cover the straight-tubular side-plate suction part 3*a* of the side plate 3 for constituting the fan suction port 1*a* substantially in parallel therewith, and the air guide part 6*c* formed along the surface of the air guide wall 3*b* constituting an airflow guide part of the side plate 3 inside the fan, substantially in parallel therewith for guiding the blowing-out airflow of the centrifugal fan 1 outside from the air guide blowing-out port 6*b*. The air guide part 6*c* is formed so as to gradually expand toward the air guide blowing-out port 6*b* from the fan blow-out port 1*b*.

Furthermore, there is provided a drain pan 24 formed of an expanded material for heat insulation and for temporarily storing condensed water generated in the cooled heat exchanger 22 in a cooling mode. The airflow guide plate 6 is fixed to the drain pan 24 with screws or an adhesive; alternatively it may be formed integrally with the drain pan 24.

Furthermore, the centrifugal fan 1 is fixed by the rotation shaft 0 of the fan motor 7 fixedly hung from a top plate 20*c* of the body 20, and the boss 2*a*, and arranged within the body 20 surrounded by the airflow guide plate 6 and the ceiling panel 23. On the air conditioner of the sixth embodiment, any centrifugal fan 1 according to the first to fifth embodiments may be mounted.

In the air conditioner described above, upon energizing the fan motor 7 with a power source, the centrifugal fan 1 is driven so that air in the room 30 is sucked from the ceiling suction port 31 into the loft 30*b*. Then, the air passes through the body suction port 20*a* and is cleared by eliminating dust and odor of the room 30 and the loft 30*b* with the dust filter 21. Then, the air is cooled/heated/dehumidified in the heat exchanger 22 and sucked into the centrifugal fan 1. The airflow ejected from the centrifugal fan 1 is controlled to be directed obliquely downward by the airflow guide plate 6; then the air is ejected from blow-out ports 23*a* of the ceiling panel 23 arranged on the bottom of the body 20, so that the room 30 is air-conditioned.

When air is sucked into the centrifugal fan 1, the end portion of the side plate on the side of the suction port of the centrifugal fan 1 is covered with the bell-mouth 6*a* of the airflow guide plate 6. Therefore, the rotation of the centrifugal fan 1 does not affect air in the vicinity of the suction port so as to suck much more air into the centrifugal fan 1 in comparison with a case without the bell-mouth 6*a*.

By configuring the air conditioner in such a manner, since the ceiling suction port 31 for sucking air in the room 30 is apart from the blow-out ports 23*a* of the ceiling panel 23, a short cycle phenomenon can be prevented, in which part of the air flow from the blow-out ports 23*a* is directly sucked into the body suction port 20*a*, enabling the room temperature to be uniform.

Also, since the loft 30*b* is used as a flow path for sucking air, an air duct can be eliminated, reducing equipment expenses and construction cost, while the channel resistance can be reduced and the loft can be maintained clean.

Furthermore, since the centrifugal fan 1 and the airflow guide plate 6 of the present invention are accommodated inside the body 20 so that air can be obliquely ejected, damage during transportation of the centrifugal fan is eliminated, whereas a conventional centrifugal fan must be protruded from the body due to the radial air ejection, resulting in the damage during transportation. Furthermore, packaging can be simplified, reducing packaging materials in favor of environment.

When the airflow guide plate 6 and the drain pan 24 are integrally formed of an expanded material, the parts count may be reduced and dew condensation is eliminated due to the insulation of cool air inside the body, improving quality.

When the air conditioner is provided with a deodorization filter instead of the heat exchanger, odor of room air can be removed, improving comfortableness. When the air conditioner is provided with a humidification filter 33 instead of the heat exchanger, the humidity of the room 30 can be maintained, improving comfortableness. Furthermore, when the heat exchanger is removed, the air conditioner serves as a blower for circulating air to suppress the temperature difference between upper and lower portions of the room 30.

In the centrifugal fan 1, the airflow blowing out in a direction substantially perpendicular to the blade rear edge 4*b* is directed toward the center of the fan blow-out port due to the concave shape so as to eject the air obliquely. Furthermore, the airflow guide plate 6 is integrally formed of the bell-mouth 6*a* formed to cover the straight-tubular side-plate suction part 3*a* substantially in parallel therewith, and the air guide part 6*c* formed along the surface of the air guide wall 3*b* constituting an airflow guide part of the side plate inside the fan substantially in parallel therewith for guiding the blowing-out airflow of the centrifugal fan 1 outside from the air guide blowing-out port 6*b*. The air guide part 6*c* gradually expands toward the air guide blowing-out port 6*b* from the fan blow-out port 1*b*, so that the fan blow-out flow can be gradually decelerated and the airflow is stabilized, reducing the draft resistance at the blow-out ports 23*a* of the ceiling panel on the downstream side of the air guide blowing-out port 6*b* and the noise level. Simultaneously, the draft resistance in the wind direction control is also reduced, so that air can be sent over a wide range by suppressing the increase in draft resistance and the flow separation at a wind-direction vane 23*b* so as to reduce the noise deterioration even at the time when the angle of the wind-direction vane 23*b* is changed for changing blowing direction from the blow-out ports 23*a*. As a result, the temperature unevenness is prevented through all the room area, improving comfortableness.

Also, the airflow guide plate 6 is integrally formed of the bell-mouth 6*a* formed at a position in the vicinity of the side plate 3 of the centrifugal fan 1 and separated from the side plate 3 by a predetermined distance to cover the straight-tubular side-plate suction part 3*a* constituting the fan suction port 1*a* substantially in parallel therewith, and the air guide wall 6*c* formed along the surface of an air guide wall 3*b* constituting the airflow guide part of the side plate inside the fan substantially in parallel therewith, so that the airflow, inversely circulating through the space between the side plate 3 and the airflow guide plate 6 toward the fan suction port 1*a* from the fan blow-out port 1*b*, can be suppressed so as to reduce the turbulence due to the airflow, enabling the noise level to be reduced.

Since the bell-mouth 6*a* and the air guide part 6*c* are integrated into the airflow guide plate 6, one part count is only required, so that the assembled individual difference due to the displacement in a screwing process and a positioning process, which are otherwise required, is suppressed, enabling the unevenness of blowing characteristics to be reduced and facilitating assembling.

As a result, in the air conditioner having the centrifugal fan of the present invention mounted thereon, the room temperature can be uniformised, odor of room air can be removed, or the humidity of the room 30 can be maintained, so that comfortableness is improved; the air conditioner can be installed at low cost and the installation easiness is high; the loft can be maintained clean improving cleanliness; packaging materials for preventing the centrifugal fan from being damaged during transportation can be environmental-friendly reduced; and variations in assembling are reduced, improving quality.

The invention claimed is:

1. A centrifugal fan comprising:

a main plate having a flat portion formed on the outer circumferential side and a convex boss formed at the center for serving as a fixing part of a rotation shaft of a motor;

a side plate, having an air guide wall, provided to surround around the boss with a predetermined space therebetween; and a plurality of blades provided between the main plate and the side plate substantially perpendicularly to a plane orthogonal to the rotation axis of the fan, wherein due to rotation of the plurality of blades, air is sent from a suction port formed between the wall of the main plate on the side of the boss and an end portion of the side plate opposing the wall on the side of the boss, toward a blow-out port formed between an external circumferential side flat portion of the main plate and an end portion of the side plate opposing the external circumferential side flat portion, and wherein when a blade edge positioned on the downstream side of the blowing direction is designated as a blade rear-edge, the centrifugal fan has a relationship of the outer diameter of the side plate>the outer diameter of the blade rear-edge on the side of the side plate>the outer diameter of the blade rear-edge on the side of the main plate≧the outer diameter of the main plate, and the blade rear-edge is located inside of a straight line connecting a connection point between the blade rear-edge and the main plate to a connection point between the blade rear-edge and the side plate relative to a rotation axis, and the distance between the blade rear edge and the rotation axis increases toward the side plate from the main plate.

2. The centrifugal fan of claim 1, wherein the thickness of an outer blade part, formed on the outer circumferential side of a blade parting line connecting the connection point between the blade rear-edge and the main plate to the connection point between the blade front-edge and the side plate, is smaller than that of the inner blade part, and a step is formed due to the thickness difference between the outer blade part and the inner blade part.

3. The centrifugal fan of claim 2, wherein the blades are formed so that the thickness of the outer blade part formed on the outer circumferential side of the blade parting line increases toward the side plate from the main plate while the thickness of the inner blade part formed on the inner circumferential side of the blade parting line conversely decreases toward the side plate from the main plate, and the step, formed due to the thickness difference between the inner blade part and the outer blade part, increases toward the main plate from the side plate.

4. The centrifugal fan of claim 3, wherein the centrifugal fan has a relationship of the outer diameter of the blade rear-edge on the side of the main plate<the outer diameter of the blade front-edge on the side of the side plate, and the blade parting line is formed so that the distance between the rotation axis and a point on the blade parting line is positioned at least between the radius of the blade rear-edge on the side of the main plate and the radius of the blade front-edge on the side of the side plate, and furthermore, the distance to the rotation axis increases toward the side plate from the main plate.

5. The centrifugal fan of claim 1, wherein the blades are formed so that the angle, defined by a blade-outlet representative line and a blade-outlet inclination reference line, ranges at least from 20 to 60° on a longitudinal section including the rotation axis, the blade-outlet representative line being a straight line connecting a main plate side connection point of the blade rear-edge to a side plate side connection point of the blade rear-edge, and the blade-outlet inclination reference line being a straight line passing a connection point of the blade rear-edge on the side of the main plate in parallel with the rotation axis.

6. The centrifugal fan of claim 1, wherein the blade rear edge is formed so as to satisfy the relations that the ratio of the maximal distance between the blade-outlet representative line and a point on the blade rear-edge to the length of the blade-outlet representative line ranges from 0.1 to 0.2, and that the ratio of the distance between the intersection point of the blade-outlet representative line and its perpendicular line passing through a point on the blade rear-edge part, at which the distance between the blade-outlet representative line and the blade rear-edge part is maximized, and the blade rear-edge main plate side connection point, to the length of the blade-outlet representative line, ranges from 0.15 to 0.7.

7. The centrifugal fan according to claim 1, wherein the ratio of the diameter of the fan suction port, formed of the end portion of the side plate on the suction side, to the outer diameter of the main plate ranges from 1.02 to 1.1.

8. The centrifugal fan according to claim 1, wherein the boss is protruded from the fan suction port, and the diameter of the main plate on the plane of the fan suction port is larger at least than that of the rotation shaft of the motor while it is 30% of the diameter of the fan suction port or less.

9. The centrifugal fan according to claim 1, wherein the side plate is provided with a straight-tubular side-plate suction part arranged for constituting the fan suction port, and the centrifugal fan further comprises an airflow guide plate integrally formed of a bell-mouth formed at a position apart from the side plate by a predetermined distance to cover the side-plate suction part substantially in parallel therewith, and an air guide part formed along the surface of the air guide wall substantially in parallel therewith to guide the blowing airflow of the centrifugal fan outside.

10. The centrifugal fan according to claim 1, wherein the side plate is provided with a straight-tubular side-plate suction part constituting the fan suction port, and at the connection part between the side-plate suction part and the air guide wall, the inner diameter of the end portion of the air guide wall on the suction side is larger than the inner diameter of the side-plate suction part.

11. The centrifugal fan according to claim 10, wherein the connection part of the side plate includes a plane substantially perpendicular to the rotation axis.

12. An air conditioner comprising the centrifugal fan according to claim 1.

13. An air conditioner having the centrifugal fan according to claim 9 mounted thereon, the air conditioner comprising:

a body panel provided on the ceiling of a room to be air-conditioned by the air conditioner and having a blow-out port for making air to blow out from the inside of an air conditioner body;

a side wall raised along the outer circumference of the body panel;

a top plate of the air conditioner provided for covering the plane of the side wall opposed to the body panel;

a body suction port formed on the side wall of the air conditioner body;

a heat exchanger arranged in the vicinity of the body suction port;

a fan motor fixed on the top plate of the air conditioner;

the centrifugal fan configured to suck the air inhaled through the body suction port and the heat exchanger for ejecting the air into the room along with the rotation of the rotation shaft of the motor; and an airflow guide plate formed to separate the airflow on the suction side of the centrifugal fan from the airflow on the ejecting side on guide the airflow on the ejecting side of the centrifugal fan toward blow-out ports of the body panel.

14. The air conditioner according to claim 13, wherein the body panel is provided at substantially the same height as that of the ceiling.

* * * * *